US012042900B2

(12) United States Patent
Ahn et al.

(10) Patent No.: US 12,042,900 B2
(45) Date of Patent: Jul. 23, 2024

(54) POLISHING SYSTEM, POLISHING PAD AND METHOD OF MANUFACTURING SEMICONDUCTOR DEVICE

(71) Applicant: SK enpulse Co., Ltd., Gyeonggi-do (KR)

(72) Inventors: Jae In Ahn, Gyeonggi-do (KR); Kyung Hwan Kim, Seoul (KR); Kang Sik F Myung, Gyeonggi-do (KR); Jang Won Seo, Seoul (KR)

(73) Assignee: SK ENPULSE CO., LTD., Gyeonggi-Do (KR)

( * ) Notice: Subject to any disclaimer, the term of this patent is extended or adjusted under 35 U.S.C. 154(b) by 140 days.

(21) Appl. No.: 17/824,086

(22) Filed: May 25, 2022

(65) Prior Publication Data

US 2022/0379427 A1 Dec. 1, 2022

(30) Foreign Application Priority Data

May 26, 2021 (KR) ..... 10-2021-0067538

(51) Int. Cl.
*B24B 37/10* (2012.01)

(52) U.S. Cl.
CPC ..... *B24B 37/10* (2013.01)

(58) Field of Classification Search
CPC ..... B24B 37/10; B24B 37/20; B24B 37/22; B24B 37/24; B24B 37/26; B24B 49/02; B24D 3/28; B24D 7/02; B24D 7/04; B24D 9/08; B24D 9/085; H01L 21/02013; H01L 21/67092
See application file for complete search history.

(56) References Cited

U.S. PATENT DOCUMENTS

2001/0031612 A1 10/2001 Scott et al.
2019/0389033 A1 12/2019 Yun et al.

FOREIGN PATENT DOCUMENTS

JP 2006-346805 A 12/2006
JP 2006346805 A 12/2006
KR 10-2020-0139290 A 12/2020

OTHER PUBLICATIONS

English translation of KR 20200139290A (Year: 2020).*
English translation of JP 2006346805A (Year: 2006).*
(Continued)

*Primary Examiner* — Laura C Guidotti
*Assistant Examiner* — Sukwoo James Chang
(74) *Attorney, Agent, or Firm* — IP & T GROUP LLP

(57) ABSTRACT

The present disclosure relates to a polishing system in which accuracy and easiness of attachment and detachment of a polishing pad to a surface plate are maximized, the polishing system including: a surface plate having a polishing pad mounted on an upper portion; and the polishing pad mounted on the surface plate, in which the polishing pad includes: a polishing surface and a surface plate attachment surface that is a rear surface of the polishing surface, the surface plate attachment surface includes: at least one engraved portion, the surface plate includes at least one embossed portion, and the embossed portion and the engraved portion have a complementary coupling structure, and a method of manufacturing a semiconductor device to which the polishing system is applied.

17 Claims, 7 Drawing Sheets

(56) References Cited

OTHER PUBLICATIONS

Office Action issued for the Taiwanese Patent Application No. 111119578 issued by the Taiwanese Patent Office on Jul. 24, 2023.
Office Action for the Korean Patent Application No. 10-2021-0067538 issued by the Korean Patent Office on Jan. 30, 2023.
Office Action for the Chinese Patent Application No. 202210578502.7 issued by the Chinese Patent Office on Jul. 7, 2023.

* cited by examiner

[FIG. 1]
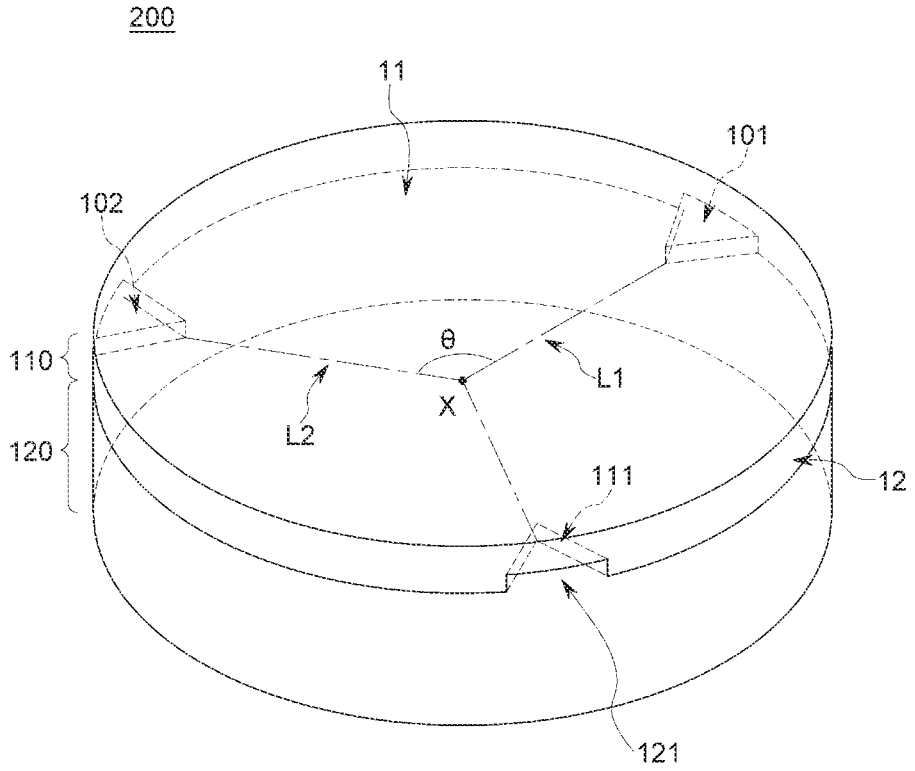

[FIG. 2]
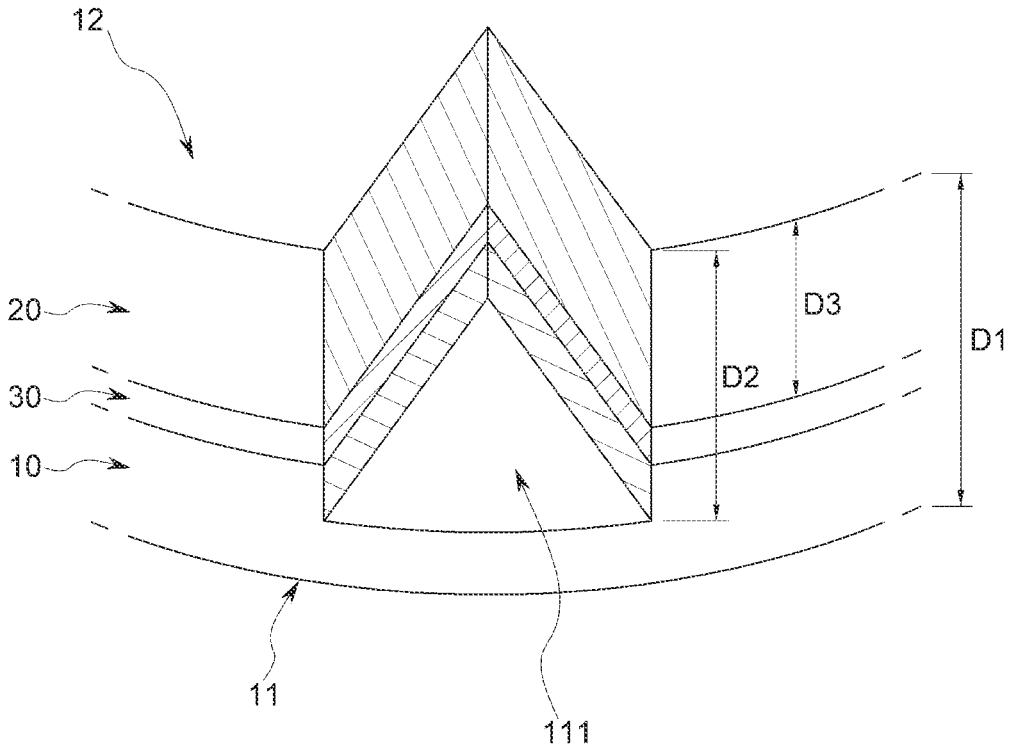

[FIG. 3]
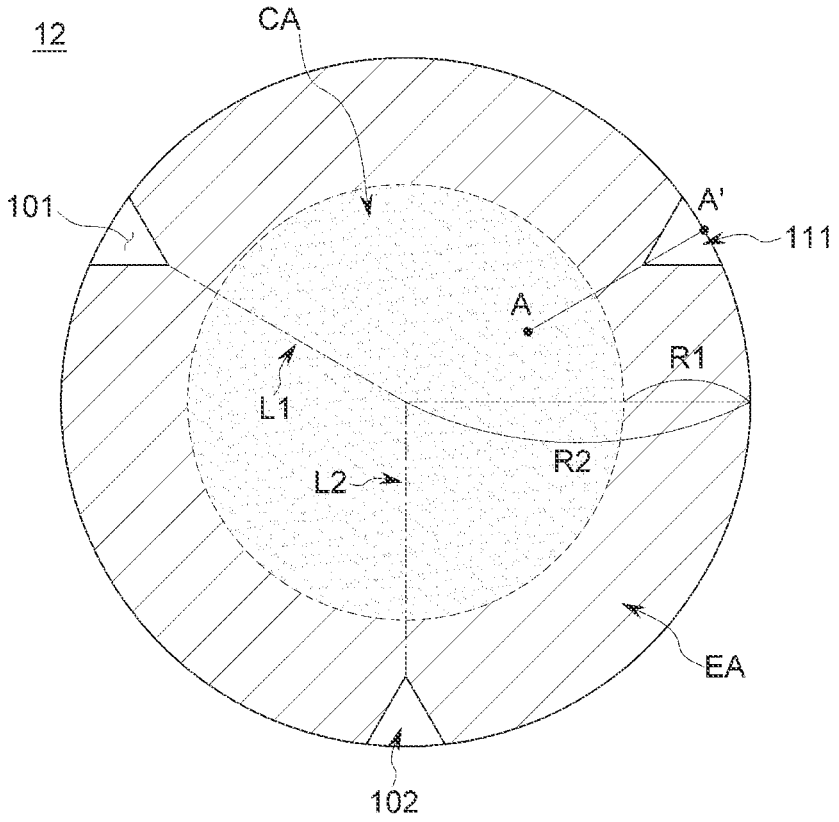

[FIG. 4]
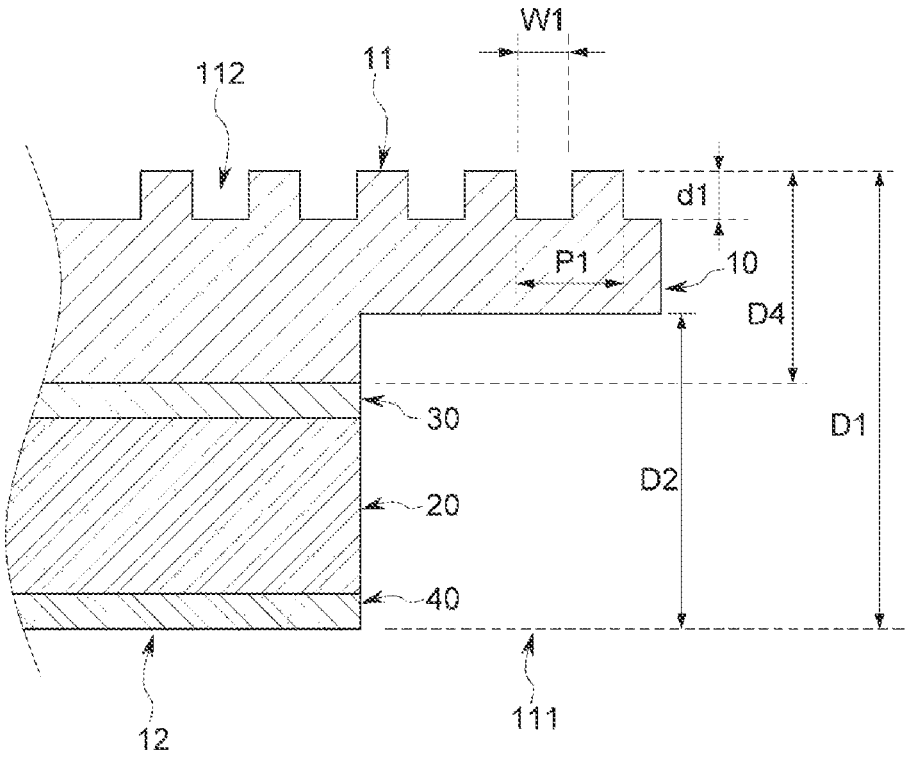

[FIG. 5]
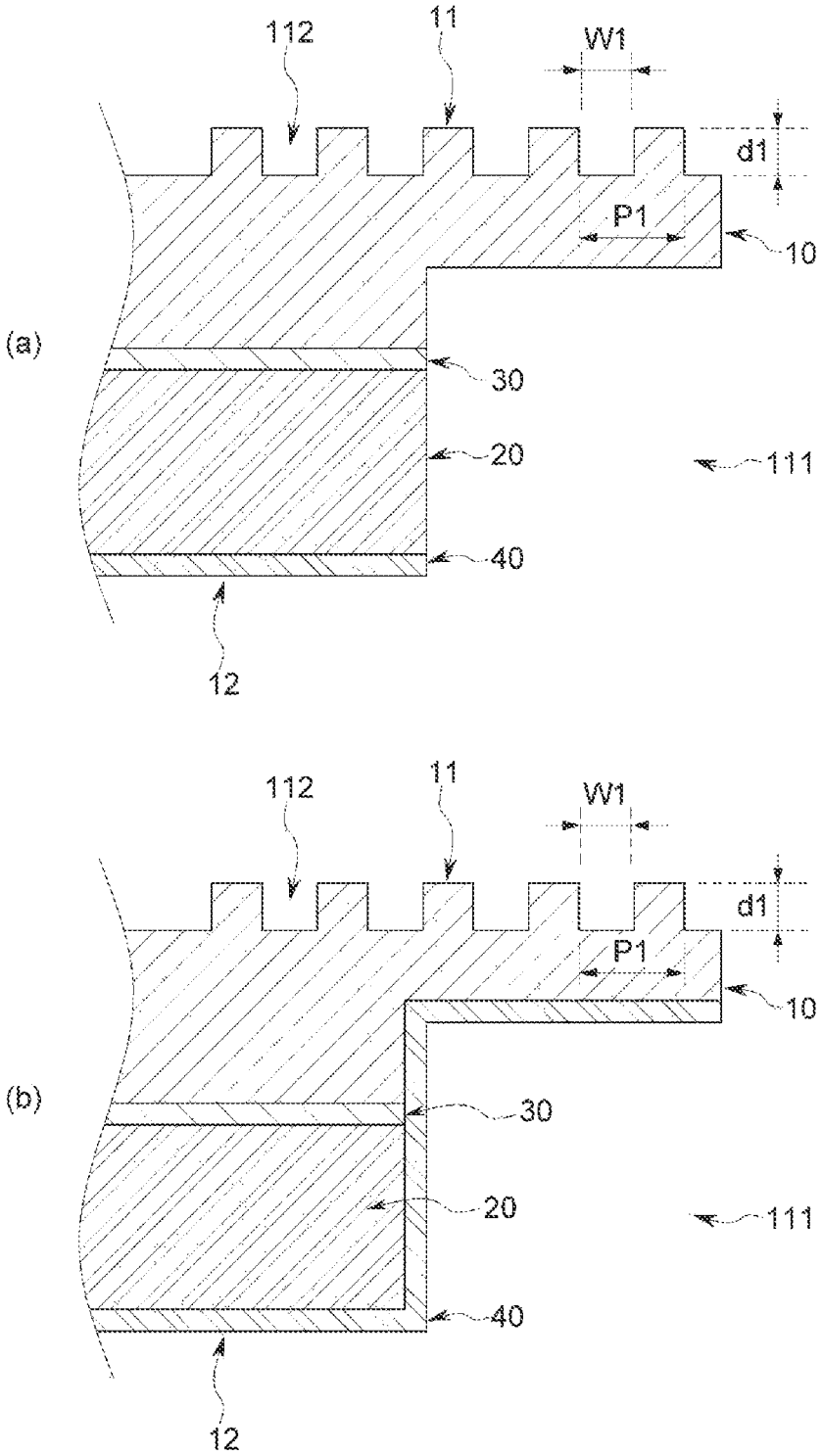

[FIG. 6]
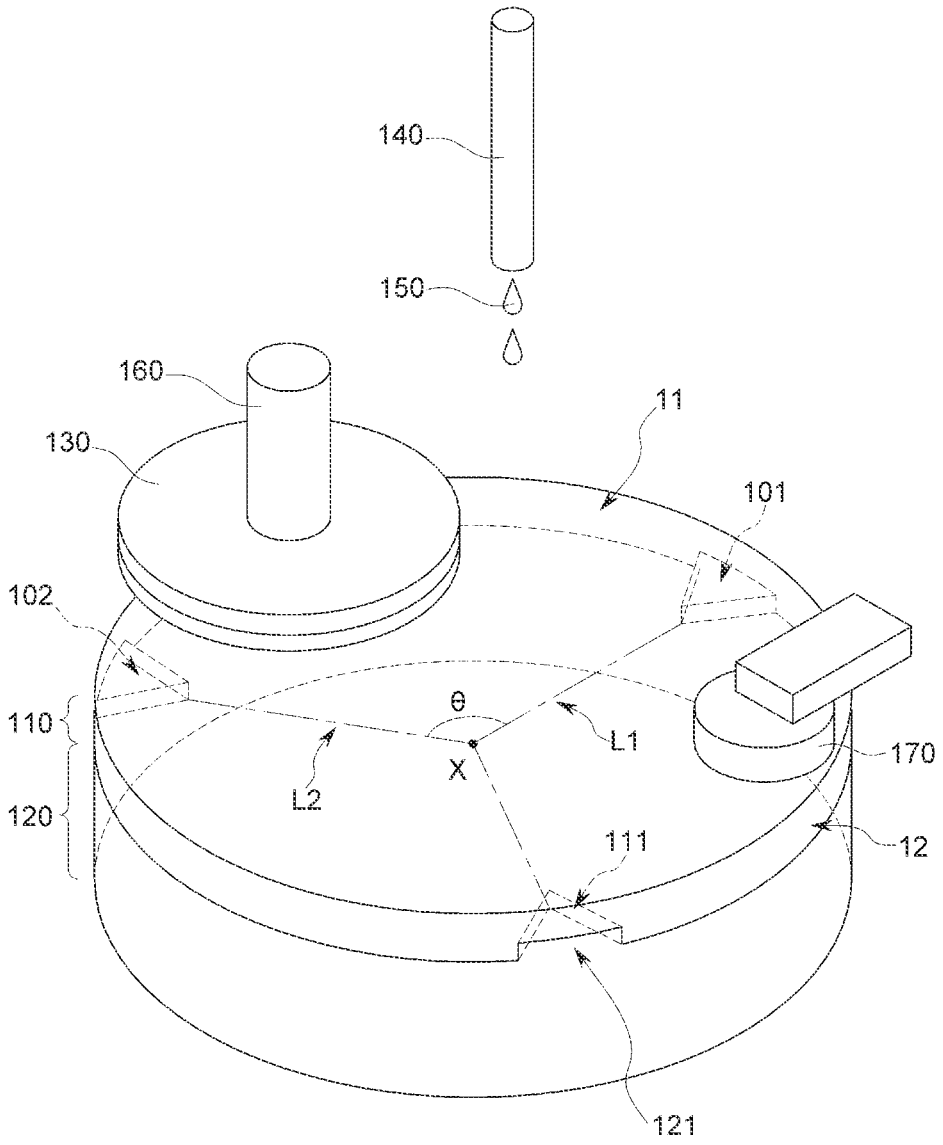

[FIG. 7]
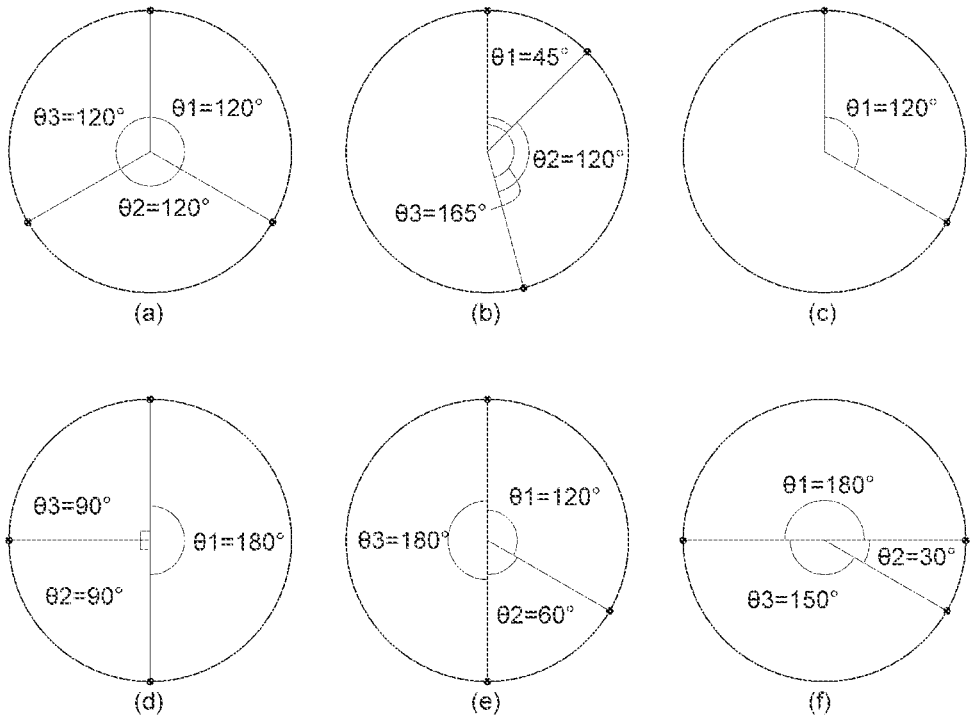

POLISHING SYSTEM, POLISHING PAD AND METHOD OF MANUFACTURING SEMICONDUCTOR DEVICE

CROSS-REFERENCE TO RELATED APPLICATION(S)

This application claims benefit of priority to Korean Patent Application No. 10-2021-0067538 filed on May 26, 2021 in the Korean Intellectual Property Office, the disclosure of which is incorporated herein by reference in its entirety.

BACKGROUND

(a) Technical Field

The present disclosure relates to a polishing system applied to a polishing process, a polishing pad applied to the polishing system, and a method of manufacturing a semiconductor device to which the polishing system is applied.

(b) Background Art

A chemical mechanical planarization (CMP) or chemical mechanical polishing (CMP) process may be performed for various purposes in various technical fields. The CMP process is performed on a predetermined polishing surface of an object to be polished, and may be performed for the purposes of planarization of the polishing surface, removal of aggregated materials, resolution of damage to crystal lattices, and removal of scratches and contaminants.

The CMP process technology of the semiconductor process may be classified according to the quality of the film to be polished or the shape of the surface after polishing. For example, it may be classified into single silicon or polysilicon according to the quality of a film to be polished, and the CMP process technology may be classified into CMP processes of various oxide films or metal films such as tungsten (W), copper (Cu), aluminum (Al), ruthenium (Ru), and tantalum (Ta) classified by the types of impurities. In addition, the CMP process may be classified into a process of alleviating the roughness of a substrate surface, a process of planarizing a stepped portion caused by multilayer circuit wirings, and a device isolation process of selectively forming the circuit wirings after polishing according to the shape of the surface after polishing.

A plurality of CMP processes may be applied in the process of manufacturing the semiconductor device. The semiconductor device includes a plurality of layers, and each layer includes a complex and fine circuit pattern. In addition, in recent semiconductor devices, individual chip sizes are reduced, and the patterns of each layer are evolving to become more complex and finer. Accordingly, in the process of manufacturing the semiconductor device, the purpose of the CMP process has been expanded to the applications that not only planarize the circuit wirings, but also separate the circuit wirings and improve wiring surfaces, and as a result, more sophisticated and reliable CMP performance is being required.

The polishing pad used in the CMP process is a process component for processing a polishing surface to a required level through friction, and may be regarded as one of the most important factors in thickness uniformity of the object to be polished, and flatness and polished quality of the polishing surface after polishing.

SUMMARY OF THE DISCLOSURE

In one embodiment, there is provided a polishing system capable of accurate attachment and easy detachment of the polishing pad, the polishing system capable of eventually implementing excellent polishing performance in terms of a polishing rate, a polishing flatness, and a defect prevention as a life time of the system is prolonged and polishing efficiency is greatly improved.

In another embodiment, there is provided a polishing pad optimized to be applied to the polishing system, the polishing pad capable of maximizing efficiency of the polishing system in terms of its own physical property and structure.

In still another embodiment, there is provided, as a method of manufacturing a semiconductor device, a process means capable of applying the polishing pad optimized for a semiconductor process and the polishing system to which the polishing pad is applied in the semiconductor process in which a fine and precise process control is essential, thereby eventually greatly improving efficiency of the process of manufacturing the semiconductor device, and implementing the surface of a finally polished semiconductor substrate with excellent physical property.

In one embodiment, there is provided a polishing system including: a surface plate having a polishing pad mounted on an upper portion; and a polishing pad mounted on the surface plate, in which the polishing pad includes: a polishing surface and a surface plate attachment surface that is a rear surface of the polishing surface, the surface plate attachment surface includes: at least one engraved portion, the surface plate includes at least one embossed portion, and the embossed portion and the engraved portion have a complementary coupling structure.

The surface plate attachment surface may include: at least two engraved portions, and when straight lines from a center of each of an arbitrary first engraved portion and second engraved portion among the at least two engraved portions to a center of the polishing pad on the surface plate attachment surface are a first straight line and a second straight line, an inner angle θ between the first straight line and the second straight line may satisfy Equation 1 below.

$$-1<\cos\theta<1 \qquad \text{Equation 1}$$

The polishing pad may include: a polishing layer including the polishing surface; and a cushion layer including the surface plate attachment surface, and a depth D2 of the engraved portion may satisfy the correlation of Equation 2 below with a thickness D3 of the cushion layer and a thickness D1 of the polishing pad.

$$D3<D2<D1 \qquad \text{Equation 2}$$

The polishing pad may include: a polishing layer including the polishing surface; and a cushion layer including the surface plate attachment surface, the polishing surface may include: at least one groove having a depth smaller than the thickness of the polishing layer, and a depth D2 of the engraved portion may satisfy the correlation of Equation 3 below with a thickness D4 of the polishing layer, a depth d1 of the groove, and a thickness D1 of the polishing pad.

$$D1-D4+((D4-d1))/10<D2<D1-D4+((D4-d1))/2 \qquad \text{Equation 3}$$

The surface plate attachment surface may include: a center area and an edge area, when the edge area is an area where a straight distance from a rim of the surface plate attachment surface toward the center of the polishing pad corresponds to a first straight distance R1, and the straight distance from a rim of the surface plate attachment surface toward the center of the polishing pad corresponds to a second straight distance R2, a ratio of the second straight distance R2 to the first straight distance R1 may be 0.2:1 to 0.5:1, and the engraved portion may be located in the edge area.

In another embodiment, there is provided a polishing pad including: a polishing surface and a surface plate attachment surface on a rear surface of the polishing surface, in which the surface plate attachment surface includes: at least one engraved portion, and the engraved portion has a complementary coupling structure with an embossed portion on a surface plate to be mounted through the surface plate attachment surface.

The polishing pad may include: a polishing layer including the polishing surface; and a cushion layer including the surface plate attachment surface, and a depth D2 of the engraved portion may satisfy the correlation of Equation 2 below with a thickness D3 of the cushion layer and a thickness D1 of the polishing pad.

$$D3<D2<D1 \qquad \text{Equation 2}$$

The polishing pad may include: a polishing layer including the polishing surface; and a cushion layer including the surface plate attachment surface, in which the polishing surface may include: at least one groove having a depth smaller than the thickness of the polishing layer, and a depth D2 of the engraved portion may satisfy the correlation of Equation 3 below with a thickness D4 of the polishing layer, a depth d1 of the groove, and a thickness D1 of the polishing pad.

$$D1-D4+((D4-d1))/10<D2<D1-D4+((D4-d1))/2 \qquad \text{Equation 3}$$

In the polishing pad, the polishing layer may include: a cured product of a preliminary composition including a urethane-based prepolymer, and the content of an isocyanate group (NCO %) in the preliminary composition may be 5 wt to 11 wt %.

The polishing surface may include: two or more grooves, the groove has a depth of 100 μm to 1500 μm, and a width of 100 μm to 1000 μm, and a pitch between adjacent two grooves may be 2 mm to 70 mm.

In still another embodiment, there is provided a method of manufacturing a semiconductor device, the method including: coupling a polishing pad including a polishing surface and a surface plate attachment surface on a rear surface of the polishing surface to a surface plate; and polishing an object to be polished while relatively rotating the polishing pad and the object to be polished under a pressurization condition after a surface to be polished of the object to be polished is disposed to come into contact with the polishing surface, in which the object to be polished includes: a semiconductor substrate, the surface plate attachment surface includes: at least one engraved portion, the surface plate includes: at least one embossed portion, and in the coupling of the polishing pad to the surface plate, the embossed portion and the engraved portion are coupled to be engaged with each other.

A load by which the surfaced to be polished of the object to be polished is pressurized on the polishing surface of the polishing layer may be 0.01 psi to 20 psi. Rotation speeds of the polishing pad and the object to be polished may be 10 rpm to 500 rpm, respectively.

The polishing system has the advantage capable of the accurate attachment and the easy detachment between the polishing pad and the surface plate through the complementary coupling structure between the engraved portion and the embossed portion, thereby preventing the surface plate from being damaged and deformed to prolong the life time of the system, and greatly improving the polishing efficiency by shortening the process time and the like to eventually implement excellent polishing performance in terms of the polishing rate, the polishing flatness, and the defect prevention.

The polishing pad can serve as the polishing pad optimized for the polishing system through the characteristics of the structure and composition of the polishing pad appropriately designed, and as a result, it is possible not only to maximize the efficiency of the polishing system, but also greatly improve the polishing yield and performance of the semiconductor process to which the polishing pad is applied according to the surface provided by the polishing pad itself.

The method of manufacturing the semiconductor device is the manufacturing process to which the polishing system and the polishing pad are applied, and can perform the fine and precise process control through the polishing pad and the polishing system to which the polishing pad is applied. As a result, the efficiency of the manufacturing process can be greatly improved, and the finally polished surface of the semiconductor substrate can implement the excellent physical property in terms of the polishing flatness and the defect prevention, thereby greatly improving the quality of the semiconductor device.

BRIEF DESCRIPTION OF THE DRAWINGS

FIG. 1 schematically shows a perspective view of a polishing system according to one embodiment.

FIG. 2 is an enlarged perspective view showing an engraved portion according to one embodiment.

FIG. 3 is an enlarged perspective view showing an engraved portion according to another embodiment.

FIG. 4 is a plan view schematically showing a surface plate attachment surface of a polishing pad according to one embodiment.

FIG. 5 schematically shows a cross-sectional view in a thickness direction of the polishing pad corresponding to A-A' of FIG. 4.

FIG. 6 is a view schematically showing a method of manufacturing a semiconductor device according to one embodiment.

FIG. 7 schematically shows angles between engraved portions in the embodiments according to location of the engraved portion.

DETAILED DESCRIPTION

Advantages and features of the present disclosure, and a method for achieving them will become apparent with reference to the embodiments described below. However, the present disclosure is not limited to the embodiments disclosed below but can be implemented in various different forms, and only the present embodiment is provided to serve to complete the disclosure of the present disclosure, and to fully inform those skilled in the art to which the present disclosure pertains of the scope of the disclosure, and the present disclosure is only defined by the scope of the claims.

In the drawings, thicknesses are enlarged to clearly express various layers and areas. In addition, in the drawings, for convenience of description, the thicknesses of some layers and areas are exaggerated. The same reference numerals refer to the same components throughout the specification.

In addition, in the present specification, when a portion of a layer, a film, an area, a plate, etc. is "on" or "above"

another portion, this includes not only a case in which a portion is "directly on" another portion, but also a case in which other portions are interposed therebetween. Conversely, when a portion is "directly on" another portion, this means that there is no other portions therebetween. In addition, when a portion of a layer, a film, an area, a plate, etc. is "below" or "under" another portion, this includes not only a case in which a portion is formed "directly below" another portion, but also a case in which other portions are interposed therebetween. Conversely, when a portion is "directly below" another portion, this means that there is no other portions therebetween.

In one embodiment, there is provided a polishing system including: a surface plate having a polishing pad mounted on an upper portion; and the polishing pad mounted on the surface plate, in which the polishing pad includes a polishing surface and a surface plate attachment surface that is a rear surface of the polishing surface, the surface plate attachment surface includes at least one engraved portion, the surface plate includes at least one embossed portion, and the embossed portion and the engraved portion have a complementary coupling structure.

FIG. 1 is a perspective view schematically showing one embodiment of a polishing system 200. Referring to FIG. 1, the polishing system 200 includes a surface plate 120 and a polishing pad 110, and the polishing pad includes a polishing surface 11 and a surface plate attachment surface 12 that is a rear surface of the polishing surface 11.

The surface plate 120 includes at least one embossed portion 121, the surface plate attachment surface 12 includes at least one engraved portion 111, and the embossed portion 121 and the engraved portion 111 have the complementary coupling structure.

The polishing system 200 may be applied to various technical fields, and for example, applied to a process of manufacturing a semiconductor device to implement excellent polishing performance. The polishing system 200 to which the complementary coupling structure between the embossed portion 121 and the engraved portion 111 is applied enables the accurate detachment and attachment of the polishing pad 110, and at the same time, may implement the excellent polishing flatness and defect prevention effects without reducing the polishing performance due to this structural non-uniformity.

Recently, with the high integration of semiconductor devices, the level of demand for the sophistication of the structure is significantly increasing. Specifically, since recent semiconductor devices require the formation of complex circuits of several nanometers (nm) level, a sophisticated and fine control is required in the manufacturing process. Accordingly, a large difference in the defect rate may occur even due to a very fine difference in a planarization process of a semiconductor thin film.

The polishing system 200 may be applied as a process element for planarizing various thin films in the process of manufacturing the semiconductor device. Since the polishing pad 110 of the polishing system 200 is applied to the process in a manner that substantially directly applies a physical force to the surface of the semiconductor substrate, a large difference in the defect rate of the semiconductor device may occur even due to a slight structural difference therebetween. Referring to FIG. 1, the surface plate attachment surface 12 of the polishing pad 110 includes at least one engraved portion 111, and the engraved portion 111 may be regarded as an element that gives non-uniformity to the entire planar structure of the polishing pad 110. Considering the process of polishing the semiconductor substrate under a pressure condition with respect to the polishing surface 11 of the polishing pad 110, such a local structural non-uniformity factor may provide locally different physical influences to the semiconductor substrate, which may negatively affect the purpose of the polishing process in which the entire polishing surface of the semiconductor substrate needs to be uniformly planarized.

However, the polishing system 200 according to one embodiment has a technical significance in that the complementary coupling structure between the engraved portion 111 and the embossed portion 112 exercises only positive influence on the polishing process of the semiconductor substrate by the features to be described in detail below. Specifically, the polishing system 200 enables the accurate detachment and attachment of the polishing pad 110 in the semiconductor manufacturing process, and at the same time, the polishing pad 110 and the surface plate 120 provides a uniform elastic force and a support rigidity to the semiconductor substrate to be polished over the entire area, thereby implementing excellent polishing flatness and defect prevention effects.

Referring to FIGS. 1 and 3, in the polishing system 200 according to one embodiment, the surface plate attachment surface 12 of the polishing pad 110 includes at least two engraved portions 111, and when straight lines from each center of arbitrary first engraved portion 101 and second engraved portion 102 among the at least two engraved portions 111 to a center X of the polishing pad 110 on the surface plate attachment surface 12 are a first straight line L1 and a second straight line L2, respectively, an inner angle θ between the first straight line L1 and the second straight line L2 may satisfy Equation 1 below.

$$-1<\cos\theta<1 \qquad \text{Equation 1}$$

The 'center' of the engraved portion 111 means a midpoint on the center line that bisects the planar shape of the engraved portion 111. For example, as shown in FIGS. 1 and 3, when the planar shape of the engraved portion 111 is a symmetric fan shape, a vertex of the fan shape may be the center of the engraved portion 111.

The 'center' of the polishing pad 110 on the surface plate attachment surface 12 means that point on the surface plate attachment surface 12 when a vertical straight line is drawn from the center of gravity of the polishing pad 110 to the surface plate attachment surface 12.

The 'inner angle' between the first straight line L1 and the second straight line L2 means a relatively small angle of two angles formed by two straight lines with respect to the center of the polishing pad 111 on the surface plate attachment surface 12.

For example, as shown in FIG. 1, when the polishing pad 110 includes three engraved portions 111 on the surface plate attachment surface 12, the inner angle θ between two straight lines may satisfy the value of Equation 1 when the straight lines L1, L2 reaching the center of the polishing pad 110 on the surface plate attachment surface 12 with respect to the arbitrary two engraved portions 101, 102 among the three engraved portion 111 are drawn. In other words, even in the case of arbitrary two engraved portions 101, 102 among the three engraved portions 111, the inner angle θ between the two straight lines L1, L2 with respect to the arbitrary two engraved portions 101, 102 may not be 180°. In general, when the polishing pad is attached to the surface plate, a part of a release film previously disposed on the surface plate attachment surface of the polishing pad is released and attached to a correct location of the surface plate, and then the rest of the release film is released and attached in such a way that the surface plate attachment surface of the released portion is attached to the surface plate, and at this time, when arbitrary two engraved portions among the at least two engraved portions 111 exist at location symmetrical to each other, that is, at a location where the inner angle between the two straight lines L1, L2 satisfies 180°, a problem of having difficulty in attaching a second engraved portion to the correct location after first attaching a first engraved portion to the surface plate may occur. In other words, a plurality of engraved portions are disposed so that the inner angle between the first straight line L1 and the second straight line L2 satisfies the condition of Equation 1, so that it is possible to improve accuracy in correspondingly attaching the engraved portions to a plurality of embossed portions on the surface plate, respectively.

FIG. 2 is an enlarged perspective view of the polishing pad 111 according to one embodiment. Referring to FIG. 2, the polishing pad 110 includes a polishing layer 10 including the polishing surface 11, and a cushion layer 20 including the surface plate attachment surface 12, and a depth D2 of the engraved portion may satisfy the correlation of Equation 2 below with a thickness D3 of the cushion layer and a thickness D1 of the polishing pad.

$$D3<D2<D1 \qquad \text{Equation 2}$$

When the depth D2 of the engraved portion is too shallow, a structural deformation occurs due to a shear stress generated between the polishing pad 110, the surface plate 120, and the semiconductor substrate, thereby negatively affecting a change in the location of the polishing pad 110 disposed on the surface plate 120 and a reduction in the polishing degree of uniformity thereof. In the description of another aspect, when the depth D2 of the engraved portion is smaller than or equal to the thickness D3 of the cushion layer, the degree of structural deformation due to the shear stress generated between the polishing pad 110, the surface plate 120, and the semiconductor substrate increases compared to the structural support force of the cushion layer 20, thereby negatively affecting a change in the location of the polishing pad 110 disposed on the surface plate 120 and a reduction in the polishing degree of uniformity thereof. Conversely, when the depth D2 of the engraved portion is too deep and passes through the polishing pad 110 in a thickness direction, the embossed portion 121 of the surface plate is exposed to the outside, resulting in the occurrence of the defect of the surface to be polished of the semiconductor substrate and a reduction in the polishing degree of uniformity. In the description of another aspect, when the depth D2 of the engraved portion is equal to the thickness D1 of the polishing pad, the embossed portion 121 of the surface plate is exposed to the outside, resulting in the occurrence of the defect of the surface to be polished of the semiconductor substrate and a reduction in the polishing degree of uniformity.

FIG. 3 is a plan view schematically showing the surface plate attachment surface 12 of the polishing pad 110 according to one embodiment. Referring to FIG. 3, the surface plate attachment surface 12 includes a central area CA and an edge area EA, in which the edge area EA is an area where a straight distance directed to the center X of the polishing pad from the rim of the surface plate attachment surface 12 corresponds to a first straight distance R1, and the engraved portion 111 may be located in the edge area EA. At this time, when the straight distance from the rim of the surface plate attachment surface 12 to the center X of the polishing pad is a second straight distance R2, a ratio of the second straight distance R2 to the first straight distance R1 may be about 0.01:1 to about 0.3:1, for example, about 0.02:1 to about 0.25:1, for example, about 0.03:1 to about 0.2:1, for example, about 0.04:1 to about 0.15:1. The engraved portion 111 is located in the edge area EA of the surface plate attachment surface 12, so that it may be advantageous in improving the accuracy of the attachment and detachment of the engraved portion 111 compared to a case of being located in the central area CA, and it may be advantageous in minimizing the negative influence on polishing performance due to the structural non-uniformity.

FIG. 4 schematically shows a cross-sectional view in the thickness direction corresponding to A-A' of FIG. 3 with respect to the polishing pad 110 according to one embodiment. FIG. 4 does not show a portion visualized by passing through the inside of the engraved portion 111.

Referring to FIG. 4, the polishing pad 110 includes the polishing layer 10 including the polishing surface 11 and the cushion layer 20 including the surface plate attachment surface 12, and the polishing surface 11 may include at least one groove 112 having a depth d1 smaller than a thickness D4 of the polishing layer 10. At this time, the depth D2 of the engraved portion may satisfy the correlation of Equation 3 with the thickness D4 of the polishing layer, the depth d1 of the groove, and the thickness D1 of the polishing pad.

$$D1-D4+((D4-d1))/10<D2<D1-D4+((D4-d1))/2 \qquad \text{Equation 3}$$

The groove 112 is a structure for appropriately securing fluidity of a polishing slurry and the like applied to the polishing surface 11 in the polishing system, and is cut to have the depth d1 smaller than the thickness D4 of the polishing layer. Since the polishing surface 11 of the polishing pad is cut and worn as the polishing process continues, the depth d1 of the groove gradually becomes smaller as the polishing process by the polishing system continues. There may occur a problem in that when the depth D2 of the engraved portion is equal to or greater than an upper limit of Equation 3, the nonuniform structure of the engraved portion 111 affects the surface to be polished of the semiconductor substrate through the polishing surface 11 before the polishing surface 11 is cut and worn to reach the maximum life time of the polishing pad 110, thereby reducing the polishing degree of uniformity. In addition, when the depth D2 of the engraved portion is equal to or smaller than a lower limit of Equation 3, it is not possible to secure the structural rigidity according to the complementary coupling structure between the engraved portion 111 of the polishing pad 110 and the embossed portion 121 of the surface plate 120 at a level to resist the shear stress between the polishing pad 110, the surface plate 120, and the semiconductor substrate, and thus there is a concern in that negative results on the change in the location of the polishing pad 110 and the reduction in the polishing degree of uniformity thereof may occur.

The structure sizes of the groove 112 and the engraved portion 111 satisfy the correlation of Equation 3, so that it is possible to obtain excellent results in terms of both the accuracy of the mechanical coupling according to the complementary coupling structure between the engraved portion 111 and the embossed portion 121 and the polishing results of the object to be polished through the polishing surface 11. More specifically, the polishing pad 110 polishes the object to be polished under a pressurized environment of a predetermined pressure during use in the polishing process, and as necessary, a polishing liquid or a polishing slurry is applied to promote a chemical polishing action and the polishing pad 110 is used in wet environments. At this time, the structural sizes of the groove 112 and the engraved portion 111 satisfy the correlation of Equation 3, so that it is possible to satisfy the elastic force and rigidity transmitted to the object to be polished through the polishing surface 11 at a proper level, and at the same time, prevent invasion of the polishing liquid or the polishing slurry to improve long-term durability.

The polishing system 200 may further include a fluid injection means for applying a fluid, as necessary, such as a polishing slurry, on the polishing surface 11. The polishing slurry may be applied to the polishing surface 11 through the fluid injection means. For example, the polishing pad 110 includes at least one groove 112 in the polishing surface 11, and a flow rate of the polishing slurry injected through the fluid injection means may be about 10 ml/min to about 1,000 ml/min, for example, about 10 ml/min to about 800 ml/min, for example about 50 $cm^3$/min to about 500 $cm^3$/min. When the polishing slurry is applied to the polishing surface 11 having the groove 112 through the fluid injection means at such a flow rate, it is possible to secure a proper level of fluidity through the groove 112. For example, when the fluidity of the polishing slurry through the groove 112 is too low, the time the polishing slurry stays in the groove 112 is increased accordingly, thereby negatively affecting the polishing degree of uniformity that needs to be secured at the proper level according to the organic relationship between the depth of the groove 112 and the depth of the engraved portion 111. In other words, as the polishing slurry is injected through the fluid injection means at the flow rate in the above-described range, it may be further advantageous in securing the technical advantage of the polishing system obtained by the engraved portion 111 and the groove 112 satisfying the above-described correlation of Equation 3.

The polishing system 200 may further include a pressurization means by which a pressurizing load of the polishing pad 110 to the surface plate 120 is adjusted in a range of about 2 psi to about 7 psi. The pressurizing means may be a means for pressurizing the object to be polished with the load of the above range with respect to the polishing surface 11 of the polishing surface 110, or a means for pressurizing the polishing pad 110 to come into close contact with the surface plate 120 before the full-scale polishing process. The pressurizing load may be appropriately adjusted within the above-described range depending on the purpose of the process. The pressurizing load is adjusted within the above range, so that it is possible to minimize non-uniformity of the polishing performance by the engraved portion 111 when the polishing is performed through the polishing system 200.

In the polishing system 200, all features of the polishing pad 110, such as a structure and composition to be described later may be integrated into the features of the polishing pad 110. In other words, the polishing pad 110 applied to the polishing system 200 is a polishing pad having the feature of a polishing layer or the like formed from a preliminary composition having a predetermined stacked structure and/or a predetermined chemical composition as described later, and may have features optimized for the system 200.

In another embodiment, there is provided the polishing pad including the polishing surface and the surface plate attachment surface on the rear surface of the polishing surface, in which the surface plate attachment surface includes at least one engraved portion, and the engraved portion has the complementary coupling structure with the embossed portion on the surface plate to be mounted through the surface plate attachment surface.

All matters relating to the engraved portion and its structural features are as in the above description of the polishing system. In other words, the features of the polishing pad 110 among the content of the polishing system 200 described with reference to FIGS. 1 to 3 are integrally interpreted as the features of the polishing pad according to the present embodiment.

Referring to FIGS. 1 and 3, the surface plate attachment surface 12 of the polishing pad 110 according to one embodiment includes at least two engraved portions 111, and when the straight lines from each center of the arbitrary first engraved portion 101 and second engraved portion 102 among the at least two engraved portions 111 to the center X of the polishing pad 110 on the surface plate attachment surface 12 are the first straight line L1 and the second straight line L2, respectively, the inner angle θ between the first straight line L1 and the second straight line L2 may satisfy Equation 1 below.

$$-1<\cos\theta<1 \qquad \text{Equation 1}$$

The 'center' of the engraved portion 111 means a midpoint on the center line that bisects the planar shape of the engraved portion 111. For example, as shown in FIGS. 1 and 3, when the planar shape of the engraved portion 111 is a symmetric fan shape, a vertex of the fan shape may be the center of the engraved portion 111.

The 'center' of the polishing pad 110 on the surface plate attachment surface 12 means that point on the surface plate attachment surface 12 when a vertical straight line is drawn from the center of gravity of the polishing pad 110 to the surface plate attachment surface 12.

The 'inner angle' between the first straight line L1 and the second straight line L2 means a relatively small angle of two angles formed by two straight lines with respect to the center of the polishing pad 111 on the surface plate attachment surface 12.

For example, as shown in FIG. 1, when the polishing pad 110 includes three engraved portions 111 on the surface plate attachment surface 12, the inner angle θ between two straight lines may satisfy the value of Equation 1 when the straight lines L1, L2 reaching the center of the polishing pad 110 on the surface plate attachment surface 12 with respect to the arbitrary two engraved portions 101, 102 among the three engraved portion 111 are drawn. In other words, even in the case of arbitrary two engraved portions 101, 102 among the three engraved portions 111, the inner angle θ between the two straight lines L1, L2 with respect to the arbitrary two engraved portions 101, 102 may not be 180°. In general, when the polishing pad is attached to the surface plate, a part of a release film previously disposed on the surface plate attachment surface of the polishing pad is released and attached to a correct location of the surface plate, and then the rest of the release film is released and attached in such a way that the surface plate attachment surface of the released portion is attached to the surface plate, and at this time, when arbitrary two engraved portions among the at least two engraved portions 111 exist at location symmetrical to each other, that is, at a location where the inner angle between the two straight lines L1, L2 satisfies 180°, a problem of having difficulty in attaching a second engraved portion to the correct location after first attaching a first engraved portion to the surface plate may occur. In other words, a plurality of engraved portions are disposed so that the inner angle between the first straight line L1 and the second straight line L2 satisfies the condition of Equation 1, so that it is possible to improve accuracy in correspondingly attaching the engraved portions to a plurality of embossed portions on the surface plate, respectively.

Referring to FIG. 2, the polishing pad 110 according to one embodiment includes the polishing layer 10 including the polishing surface 11, and the cushion layer 20 including the surface plate attachment surface 12, and the depth D2 of the engraved portion may satisfy the correlation of Equation 2 below with the thickness D3 of the cushion layer and the thickness D1 of the polishing pad.

$$D3<D2<D1 \quad \text{Equation 2}$$

When the depth D2 of the engraved portion is too shallow, a structural deformation occurs due to a shear stress generated between the polishing pad 110, the surface plate 120, and the semiconductor substrate, thereby having the negative effect in terms of a change in the location of the polishing pad 110 disposed on the surface plate 120 and a reduction in the polishing degree of uniformity. In the description of another aspect, when the depth D2 of the engraved portion is smaller than or equal to the thickness D3 of the cushion layer, the degree of structural deformation due to the shear stress generated between the polishing pad 110, the surface plate 120, and the semiconductor substrate increases compared to the structural support force of the cushion layer 20, thereby negatively affecting a change in the location of the polishing pad 110 disposed on the surface plate 120 and a reduction in the polishing degree of uniformity thereof. Conversely, when the depth D2 of the engraved portion is too deep and passes through the polishing pad 110 in a thickness direction, the embossed portion 121 of the surface plate is exposed to the outside, resulting in the occurrence of the defect of the surface to be polished of the semiconductor substrate and a reduction in the polishing degree of uniformity. In the description of another aspect, when the depth D2 of the engraved portion is equal to the thickness D1 of the polishing pad, the embossed portion 121 of the surface plate is exposed to the outside, resulting in the occurrence of the defect of the surface to be polished of the semiconductor substrate and a reduction in the polishing degree of uniformity.

Referring to FIG. 3, the polishing pad 110 has the surface plate attachment surface 12 including the central area CA and the edge area EA, in which the edge area EA is an area where the straight distance directed to the center X of the polishing pad from the rim of the surface plate attachment surface 12 corresponds to the first straight distance R1, and the engraved portion 111 may be located in the edge area EA. At this time, when the straight distance from the rim of the surface plate attachment surface 12 to the center X of the polishing pad is a second straight distance R2, a ratio of the second straight distance R2 to the first straight distance R1 may be about 0.01:1 to about 0.3:1, for example, about 0.02:1 to about 0.25:1, for example, about 0.03:1 to about 0.2:1, for example, about 0.04:1 to about 0.15:1. The engraved portion 111 is located in the edge area EA of the surface plate attachment surface 12, so that it may be advantageous in improving the accuracy of the attachment and detachment of the engraved portion 111 compared to a case of being located in the central area CA, and it may be advantageous in minimizing the negative influence on polishing performance due to the structural non-uniformity.

FIG. 4 schematically shows a cross-sectional view in the thickness direction corresponding to A-A' of FIG. 3 with respect to the polishing pad 110 according to one embodiment. FIG. 4 does not show a portion visualized by passing through the inside of the engraved portion 111.

Referring to FIG. 4, the polishing pad 110 includes the polishing layer 10 including the polishing surface 11 and the cushion layer 20 including the surface plate attachment surface 12, and the polishing surface 11 may include at least one groove 112 having a depth d1 smaller than a thickness D4 of the polishing layer 10. At this time, the depth D2 of the engraved portion may satisfy the correlation of Equation 3 with the thickness D4 of the polishing layer, the depth d1 of the groove, and the thickness D1 of the polishing pad.

$$D1-D4+((D4-d1))/10<D2<D1-D4+((D4-d1))/2 \quad \text{Equation 3}$$

The groove 112 has a structure for appropriately securing the fluidity of the polishing slurry and the like applied to the polishing surface 11, and is cut to have the depth d1 smaller than the thickness D4 of the polishing layer. Since the polishing surface 11 of the polishing pad is cut and worn as the polishing process continues, the depth d1 of the groove gradually becomes smaller as the polishing process continues. There may occur a problem in that when the depth D2 of the engraved portion is equal to or greater than an upper limit of Equation 3, the nonuniform structure of the engraved portion 111 affects the surface to be polished of the semiconductor substrate through the polishing surface 11 before the polishing surface 11 is cut and worn to reach the maximum life time of the polishing pad 110, thereby reducing the polishing degree of uniformity. In addition, when the depth D2 of the engraved portion is equal to or smaller than a lower limit of Equation 3, it is not possible to secure the structural rigidity according to the complementary coupling structure between the engraved portion 111 of the polishing pad 110 and the embossed portion 121 of the surface plate 120 at a level to resist the shear stress between the polishing pad 110, the surface plate 120, and the semiconductor substrate, and thus there is a concern in that negative results on the change in the location of the polishing pad 110 and the reduction in the polishing degree of uniformity thereof may occur.

The structure sizes of the groove 112 and the engraved portion 111 satisfy the correlation of Equation 3, so that it is possible to obtain the excellent effects in the accuracy of the mechanical coupling according to the complementary coupling structure between the engraved portion 111 and the embossed portion 121 on the surface plate and the polished results of the object to be polished through the polishing surface 11. More specifically, the polishing pad 110 polishes the object to be polished under a pressurized environment of a predetermined pressure during use in the polishing process, and as necessary, a polishing liquid or a polishing slurry is applied to promote a chemical polishing action and the polishing pad 110 is used in wet environments. At this time, the structural sizes of the groove 112 and the engraved portion 111 satisfy the correlation of Equation 3, so that it is possible to satisfy the elastic force and rigidity transmitted to the object to be polished through the polishing surface 11 at a proper level, and at the same time, prevent the permeation of the polishing liquid or the polishing slurry to improve long-term durability.

Referring to FIG. 2, the polishing pad 110 includes the polishing layer 10 and the cushion layer 20, and may include an adhesive layer 30 for attaching the polishing layer 10 and the cushion layer 20. The engraved portion 111 may be formed over the polishing layer 10, the adhesive layer 30, and the cushion layer 20. The structure and composition of each layer of the polishing pad 110 is one of the main factors determining the physical properties such as hardness, elongation, and tensile strength of each layer, and may be a factor determining final polishing performance transmitted to the object to be polished through the polishing surface 11 in connection with the engraved portion 111 formed over each layer.

The polishing layer 10 is a layer that serves to provide the polishing surface 11 to the object to be polished, and provide a proper elastic force and a physical mechanical rigidity to the object to the polished so that a surface of the object to be polished may be uniformly polished, and may be regarded as the main configuration for the natural function of the polishing pad 110.

At this time, the material, structure, etc. of the polishing layer 10 may be the main factor determining the final influence on the object to be polished in connection with the engraved portion 111. The material, structure, etc. of the polishing layer may be variously determined depending on the type of the object to be polished, but it may be important that the structural nonuniform factor such as the engraved portion 111 is designed as an optimal material and structure for minimizing the negative influence on the object to be polished transmitted through the polishing surface 11.

In one embodiment, the polishing layer 10 may include a cured product of a preliminary composition containing a urethane-based prepolymer. In one embodiment, the preliminary composition may further contain a curing agent and a foaming agent. The 'prepolymer' refers to a polymer having a relatively low molecular weight in which the polymerization degree is stopped at an intermediate stage to facilitate molding in the manufacture of the cured product. The prepolymer itself may undergo an additional curing process such as heating and/or pressurization, or be mixed and react with another polymerizable compound, for example, an additional compound such as a heterogeneous monomer or a heterogeneous prepolymer, and then may be molded into a finally cured product.

In one embodiment, the urethane-based prepolymer may be manufactured by reacting an isocyanate compound with a polyol compound.

The isocyanate compound used to manufacture the urethane-based prepolymer may use one selected from the group consisting of aromatic diisocyanate, aliphatic diisocyanate, alicyclic diisocyanate, and combinations thereof. For example, the isocyanate compound may include the aromatic diisocyanate. For example, the isocyanate compound may include the aromatic diisocyanate and the alicyclic diisocyanate.

The isocyanate compound may contain one selected from the group consisting of, for example, 2,4-toluenediisocyanate (2,4-TDI), 2,6-toluenediisocyanate (2,6-TDI), naphthalene-1,5-diisocyanate, p-phenylenediisocyanate, tolidinediisocyanate, 4,4'-diphenylmethanediisocyanate, hexamethylenediisocyanate, dicyclohexylmethanediisocyanate, 4,4'-dicyclohexylmethanediisocyanate, H12MDI, isoporone diisocyanate, and combinations thereof.

The 'polyol' refers to a compound containing at least two hydroxyl groups (—OH) per molecule. In one embodiment, the polyol compound may include a dihydric alcohol compound having two hydroxyl groups, that is, diol or glycol; or a trihydric alcohol compound having three hydroxyl groups, that is, a triol compound.

The polyol compound may contain one selected from the group consisting of, for example, polyether polyol, polyester polyol, polycarbonate polyol, acryl polyol, and combinations thereof.

The polyol compound may contain one selected from the group consisting of, for example, polytetramethylene ether glycol (PTMG), polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol (DEG), dipropylene glycol (DPG), tripropylene glycol, polypropylene glycol, polypropylene triol, and combinations thereof.

The polyol compound may have a weight average molecular weight (Mw) of about 100 g/mol to about 3,000 g/mol, for example, about 100 g/mol to about 2,000 g/mol, for example, about 100 g/mol to about 1,800 g/mol.

In one embodiment, the polyol compound may contain a low molecular weight polyol having a weight average molecular weight (Mw) of about 100 g/mol or more and less than about 300 g/mol, and a high molecular weight polyol having a weight average molecular weight (Mw) of about 300 g/mol or more and about 1800 g/mol or less. The weight average molecular weight (Mw) of the high molecular weight polyol may be, for example, about 500 g/mol or more, about 1,800 g/mol or less, for example, about 700 g/mol or more, about 1,800 g/mol or less. In this case, the polyol compound may form an appropriate cross-linked structure in the urethane-based prepolymer, and the polishing layer formed by curing the preliminary composition containing the urethane-based prepolymer under a predetermined process condition may be more advantageous in implementing the above-described effects.

The urethane-based prepolymer may have a weight average molecular weight (Mw) of about 500 g/mol to about 3,000 g/mol, for example, about 600 g/mol to about 2,000 g/mol, for example, about 800 g/mol to about 1,000 g/mol. When the urethane-based prepolymer has the degree of polymerization corresponding to the above-described weight average molecular weight (Mw), the polishing layer formed by curing the preliminary composition under the predetermined process condition may be more advantageous in implementing the above-described effects.

In one embodiment, the isocyanate compound for manufacturing the urethane-based prepolymer may include an aromatic diisocyanate compound. The aromatic diisocyanate compound may contain, for example, 2,4-toluene diisocyanate (2,4-TDI), for example, 2,4-toluene diisocyanate (2,4-TDI), and 2,6-toluenediisocyanate (2,6-TDI). In addition, the polyol compound for manufacturing the urethane-based prepolymer may contain, for example, polytetramethylene ether glycol (PTMG) and diethylene glycol (DEG).

In another embodiment, the isocyanate compound for manufacturing the urethane-based prepolymer may include an aromatic diisocyanate compound and an alicyclic diisocyanate compound. The aromatic diisocyanate compound may contain, for example, 2,4-toluene diisocyanate (2,4-TDI), for example, 2,4-toluene diisocyanate (2,4-TDI), and 2,6-toluenediisocyanate (2,6-TDI). The alicyclic diisocyanate compound may include, for example, 4,4'-dicyclohexylmethane diisocyanate (H12MDI). In addition, the polyol compound for manufacturing the urethane-based prepolymer may include, for example, polytetramethylene ether glycol (PTMG) and diethylene glycol (DEG).

The content of the polytetramethylene ether glycol (PTMG) may be about 100 parts by weight to about 150 parts by weight, for example, about 105 parts by weight to about 140 parts by weight, for example, 110 parts by weight to about 140 parts by weight, for example, about 120 parts by weight to about 140 parts by weight with respect to 100 parts by weight of the total weight of the isocyanate compound.

The content of the diethylene glycol (DEG) may be about 1 part by weight to about 20 parts by weight, for example, about 1 part by weight to about 15 parts by weight with respect to 100 parts by weight of the total weight of the isocyanate compound.

When the isocyanate compound includes the aromatic diisocyanate compound, and the aromatic diisocyanate compound contains 2,4-TDI and 2,6-TDI, the content of the 2,6-TDI may be about 1 part by weight to about 40 parts by weight, for example, about 1 part by weight to about 30 parts by weight, for example, about 3 parts by weight to about 28 parts by weight, for example, about 1 part by weight to about 10 parts by weight, for example, about 20 parts by weight to about 30 parts by weight with respect to 100 parts by weight of the 2,4-TDI.

When the isocyanate compound includes the aromatic diisocyanate compound and the alicyclic diisocyanate compound, the content of the alicyclic diisocyanate compound may be about 5 parts by weight to about 30 parts by weight, for example, about 10 parts by weight to about 25 parts by weight with respect to the total 100 parts by weight of the aromatic diisocyanate compound.

When the preliminary composition satisfies the above-described compositional features, the polishing layer manufactured by curing the preliminary composition may secure appropriate physical/mechanical physical properties, effectively prevent the negative influence due to the engraved portion from being transmitted to the object to be polished through the polishing surface of the polishing layer, and implement excellent polishing performance due to the physical properties of the polishing surface itself. The preliminary composition may have an isocyanate group content (NCO %) of about 5 wt % to about 11 wt %, for example, about 5 wt % to about 10 wt %, for example, about 5 wt % to about 8 wt %, for example, about 8 wt % to about 10 wt %, for example, about 8.5 wt % to about 10 wt %. The 'content of the isocyanate group' refers to a percentage of the weight of the isocyanate group (—NCO) present as a free reactive group without urethane reaction among the total weight of the preliminary composition. The content of the isocyanate group (NCO %) of the preliminary composition may be designed by comprehensively adjusting the type and content of the monomer for manufacturing the urethane-based prepolymer, process conditions such as the temperature and pressure of the process of manufacturing the urethane-based prepolymer, and the type of additive used for manufacturing the urethane-based prepolymer. When the content of the isocyanate group satisfies the above range, the polishing layer may secure appropriate physical properties by curing the preliminary composition, and effectively block the negative influence by the engraved portion from being transmitted to the object to be polished through the polishing surface of the polishing layer.

In one embodiment, the preliminary composition may further contain a curing agent and a foaming agent. The curing agent is a compound for chemically reacting with the urethane-based prepolymer to form a final cured structure in the polishing layer 10, and may include, for example, an amine compound or an alcohol compound. Specifically, the curing agent may contain one selected from the group consisting of aromatic amines, aliphatic amines, aromatic alcohols, aliphatic alcohols, and combinations thereof.

For example, the curing agent may contain one selected from the group consisting of 4,4'-methylenebis(2-chloroaniline) (MOCA), diethyltoluenediamine (DETDA), diaminodiphenylmethane, dimethyl thio-toluene diamine (DMTDA), propanediol bis p-aminobenzoate, methylene bis-methylanthranilate, diaminodiphenylsulfone, m-xylylenediamine, isophoronediamine, ethylenediamine, diethylenetriamine, triethylenetetramine, polypropylenediamine, polypropylenetriamine, bis (4-amino-3-chlorophenyl) methane, and combinations thereof.

The preliminary composition may contain the curing agent of about 18 parts by weight to about 27 parts by weight, for example, about 19 parts by weight to about 26 parts by weight, for example, about 20 parts by weight to about 26 parts by weight with respect to 100 parts by weight of the total weight. When the content of the curing agent satisfies the above range, it may be more advantageous in implementing the desired performance of the polishing pad.

A molar ratio of isocyanate groups (—NCO) in the preliminary composition to the reactive group in the curing agent (NCO: reactive group) may be about 1:0.80 to about 1:1.20, for example, about 1:0.90 to about 1:1.10. for example, about 1:0.90 to about 1:1.00, for example, about 1:90 or more and less than about 1:1.00. The reactive group varies depending on the type of the curing agent, but may be, for example, an amine group (—$NH_2$) or a hydroxyl group (—OH). When the molar ratio of the isocyanate group in the preliminary composition to the reactive group in the curing agent satisfies the above-described range, an appropriate cross-linked structure may be formed by the chemical reaction between the urethane-based prepolymer in the preliminary composition and the curing agent, and as a result, it is possible to effectively block the negative influence by the engraved portion from being transmitted to the object to be polished through the polishing surface of the polishing layer, and implement the excellent polishing performance due to the physical property of the polishing surface itself The foaming agent may include one selected from the group consisting of a solid state foaming agent, a gaseous state foaming agent, a liquid foaming agent, and a combinations thereof as a component for forming a pore structure in the polishing layer. In one embodiment, the foaming agent may include a solid state foaming agent, a gas state foaming agent, or combinations thereof.

The average particle diameter of the solid state foaming agent may be about 5 μm to about 200 μm, for example, about 20 μm to about 50 μm, for example, about 21 μm to about 50 μm, for example, about 21 μm to about 40 μm. The average particle diameter of the solid state foaming agent may refer to the average particle diameter of a thermally expanded particle itself when the solid state foaming agent is the thermally expanded particle as described later, and may refer to the average particle diameter of the particle after being expanded by heat or pressure when the solid state foaming agent is an unexpanded particle as described later.

The solid state foaming agent may include expandable particles. The expandable particles are particles having a property of being expandable by heat or pressure, and the size in the final polishing layer may be determined by heat or pressure applied in the process of manufacturing the polishing layer. The expandable particles may include thermally expanded particles, unexpanded particles, or a combination thereof. The thermally expanded particles are particles pre-expanded by heat, and refer to particles having little or no size change due to heat or pressure applied in the process of manufacturing the polishing layer. The unexpanded particles are particles not expanded previously, and refer to particles whose final size is determined by being expanded by heat or pressure applied in the process of manufacturing the polishing layer.

The expandable particles may include a skin made of resin; and an expansion-inducing component present in an interior sealed by the skin.

For example, the skin may contain a thermoplastic resin, and the thermoplastic resin may be one or more types selected from the group consisting of vinylidene chloridebased copolymers, acrylonitrile-based copolymers, methacrylonitrile-based copolymers, and acrylic copolymers.

The expansion-inducing component may contain one selected from the group consisting of a hydrocarbon compound, a chlorofluoro compound, a tetraalkylsilane compound, and combinations thereof.

Specifically, the hydrocarbon compound may contain one selected from the group consisting of ethane, ethylene, propane, propene, n-butane, isobutene, n-butene, isobutene, n-pentane, isopentane, neopentane, n-hexane, heptane, petroleum ether, and combinations thereof.

The chlorofluoro compound may contain one selected from the group consisting of a trichlorofluoromethane ($CCl_3F$), dichlorodifluoromethane ($CCl_2F_2$), chlorotrifluoromethane ($CClF_3$), tetrafluoroethylene ($CClF_2$—$CClF_2$) and combinations thereof.

The tetraalkylsilane compound may contain one selected from the group consisting of tetramethylsilane, trimethylethylsilane, trimethylisopropylsilane, trimethyl-n-propylsilane, and combinations thereof.

The solid state foaming agent may selectively contain inorganic component-treated particles. For example, the solid state foaming agent may contain inorganic component-treated expandable particles. In one embodiment, the solid state foaming agent may contain silica ($SiO_2$) particle-treated expandable particles. The inorganic component treatment of the solid state foaming agent may prevent aggregation between a plurality of particles. The inorganic component-treated solid state foaming agent may have chemical, electrical, and/or physical properties of the foaming agent surface different from those of the inorganic component-not-treated solid state foaming agent.

The content of the solid state foaming agent may be about 0.5 parts by weight to about 10 parts by weight, for example, about 1 part by weight to about 3 parts by weight, for example, about 1.3 parts by weight to about 2.7 parts by weight, for example about 1.3 parts by weight to about 2.6 parts by weight with respect to 100 parts by weight of the urethane-based prepolymer.

The type and content of the solid state foaming agent may be designed depending on the desired pore structure and physical properties of the polishing layer.

The gas state foaming agent may include an inert gas. The gas state foaming agent may be added in a reaction process between the urethane-based prepolymer and the curing agent and used as a pore-forming element.

The type of the inert gas is not particularly limited as long as it does not participate in the reaction between the urethane-based prepolymer and the curing agent. For example, the inert gas may contain one selected from the group consisting of nitrogen gas ($N_2$), argon gas (Ar), helium gas (He), and combinations thereof. Specifically, the inert gas may contain nitrogen gas ($N_2$) or argon gas (Ar). The type and content of the gas state foaming agent may be designed depending on the desired pore structure and physical properties of the polishing layer.

In one embodiment, the foaming agent may include a solid state foaming agent. For example, the foaming agent may be formed of only a solid state foaming agent.

The solid state foaming agent may contain expandable particles, and the expandable particles may include thermally expanded particles. For example, the solid state foaming agent may consist only of thermally expanded particles. When the solid state foaming agent does not contain the unexpanded particles but consist only of the thermally expanded particles, variability of the pore structure is reduced but the predictability is increased, and thus it may be advantageous in implementing homogeneous pore properties over the entire area of the polishing layer.

In one embodiment, the thermally expanded particles may be particles having an average particle diameter of about 5 μm to about 200 μm. The average particle diameter of the thermally expanded particles may be about 5 μm to about 100 μm, for example, about 10 μm to about 80 μm, for example, about 20 μm to about 70 μm, for example, about 20 μm to about 50 μm. μm, for example, about 30 μm to about 70 μm, for example, about 25 μm to 45 μm, for example, about 40 μm to about 70 μm, for example, about 40 μm to about 60 μm. The average particle diameter is defined as $D_{50}$ of the thermally expanded particle.

In one embodiment, a density of the thermally expanded particle may be about 30 kg/m$^3$ to about 80 kg/m$^3$, for example, about 35 kg/m$^3$ to about 80 kg/m$^3$, for example, about 35 kg/m$^3$ to about 75 kg/m3, for example, 38 kg/m3 to about 72 kg/m$^3$, for example, about 40 kg/m3 to about 75 kg/m$^3$, for example, about 40 kg/m3 to about 72 kg/m$^3$.

In one embodiment, the foaming agent may include a gas state foaming agent. For example, the foaming agent may include a solid state foaming agent and a gas state foaming agent. Matters regarding the solid state foaming agent are the same as described above.

The gas state foaming agent may include nitrogen gas.

The gas state foaming agent may be injected through a predetermined injection line in the process of mixing the urethane-based prepolymer, the solid state foaming agent, and the curing agent. An injection rate of the gas state foaming agent may be about 0.8 L/min to about 2.0 L/min, for example, about 0.8 L/min to about 1.8 L/min, for example, about 0.8 L/min to about 1.7 L/min, for example, about 1.0 L/min to about 2.0 L/min, for example, about 1.0 L/min to about 1.8 L/min, for example, about 1.0 L/min to about 1.7 L/min.

The composition for manufacturing the polishing layer may further contain other additives such as a surfactant and a reaction rate adjusting agent. The names such as 'surfactant' and 'reaction rate adjusting agent' are arbitrary names based on the main role of the corresponding material, and each corresponding material does not necessarily perform only a function limited to the role by the corresponding name.

The surfactant is not particularly limited as long as it is a material that serves to prevent aggregation or overlapping of pores. For example, the surfactant may include a silicone-based surfactant.

The surfactant may be used in an amount of about 0.2 parts by weight to about 2 parts by weight with respect to 100 parts by weight of the urethane-based prepolymer. Specifically, the surfactant may be included in the content of about 0.2 parts by weight to about 1.9 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, for example, about 0.5 parts by weight to 1.5 parts by weight with respect to 100 parts by weight of the urethane-based prepolymer. When the surfactant is included in the content within the above range, pores derived from the gas state foaming agent may be stably formed and maintained in the mold.

The reaction rate adjusting agent serves to promote or delay the reaction, and may use a reaction accelerator, a reaction retarder, or both depending on the purpose. The reaction rate adjusting agent may include a reaction accelerator. For example, the reaction accelerator may be one or more types of reaction accelerators selected from the group consisting of a tertiary amine-based compound and an organometallic compound.

Specifically, the reaction rate adjusting agent may contain one or more types selected from the group consisting of triethylenediamine, dimethylethanolamine, tetramethylbutanediamine, 2-methyl-triethylenediamine, dimethylcyclohexylamine, triethylamine, triisopropanolamine, 1,4-diazabicyclo(2,2,2)octane, bis(2-methylaminoethyl)ether, trimethylaminoethylethanolamine, N,N,N,N,N"-pentamethyldiethylenetriamine, dimethylaminoethylamine, dimethylamino propylamine, benzyldimethylamine, N-ethylmorpholine, N,N-dimethylaminoethylmorpholine, N,N-dimethylcyclohexylamine, 2-methyl-2-azanovonein, dibutyltin dilaurate, stannous octoate, dibutyltin diacetate, dioctyltin diacetate, dibutyltin maleate, dibutyltin di-2-ethylhexanoate, and dibutyltin dimercaptide. Specifically, the reaction rate adjusting agent may contain one or more types selected from the group consisting of benzyldimethylamine, N,N-dimethylcyclohexylamine, and triethylamine.

The reaction rate adjusting agent may be used in an amount of about 0.05 parts by weight to about 2 parts by weight with respect to 100 parts by weight of the urethane-based prepolymer. Specifically, the reaction rate adjusting agent may be used in an amount of about 0.05 parts by weight to about 1.8 parts by weight, for example, about 0.05 parts by weight to about 1.7 parts by weight, for example, about 0.05 parts by weight to 1.6 parts by weight, for example, about 0.1 parts by weight to about 1.5 parts by weight, for example, about 0.1 parts by weight to about 0.3 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, for example, about 0.5 parts by weight to about 1 parts by weight with respect to 100 parts by weight of the urethane-based prepolymer. When the reaction rate adjusting agent is used in the above-described content range, the polishing layer having pores of the desired size and hardness may be formed by appropriately adjusting the curing reaction rate of the preliminary composition.

The polishing layer 10 includes the cured product of the preliminary composition derived from the appropriately selected compound, so that it is possible to implement uniform polishing performance over the entire area through the polishing surface despite structural nonuniform elements on the rear surface such as the engraved portion 111, and as a result, in the polished result of the object to be polished, it is possible to exert the effect of exhibiting excellent polishing flatness and the polishing rate and minimizing the occurrence of the surface defect. In addition, in spite of the local moisture permeation element such as the engraved portion 111, it is possible to maximize the moisture-proof function by the material and structure of the polishing layer 10 itself, thereby implementing long-term durability not requiring replacement even in the long-term polishing process under the wet environment in which the polishing slurry or the polishing liquid is applied.

Referring to FIG. 4, the polishing surface 11 may further include a groove or the groove 112 processed to a depth smaller than the thickness of the polishing layer 10. The polishing surface 111 may include a plurality of grooves 112. In one embodiment, the planar structure of the polishing pad 110 may have substantially a circular shape, and the plurality of grooves 112 may have a concentric circular structure disposed to be spaced apart from the planar center of the polishing layer 10 toward the edge thereof by a predetermined interval. In another embodiment, the plurality of grooves 112 may have a radial shape continuously formed from the planar center of the polishing layer 10 toward the edge thereof. In still another embodiment, the plurality of grooves 112 may include the concentric circular shape and the radial shape at the same time. The groove 112 may serve to adjust the fluidity of the polishing liquid or the polishing slurry supplied to the polishing surface 11 in the polishing process using the polishing pad 110, or adjust the physical polishing properties by adjusting the size of the area in which the polishing surface 11 and the surface to be polished of the object to be polished come into direct contact with each other.

In one embodiment, the thickness of the polishing layer may be about 0.8 mm to about 5.0 mm, for example, about 1.0 mm to about 4.0 mm, for example, about 1.0 mm to 3.0 mm, for example, about 1.5 mm to about 3.0 mm, for example, about 1.7 mm to about 2.7 mm, for example, about 2.0 mm to about 3.5 mm.

Referring to FIG. 4, in one embodiment, in the plurality of grooves 112, the depth d1 of each groove may be about 100 μm to about 1500 μm. For example, the depth d1 of each groove may be about 200 μm to about 1400 μm, for example, about 300 μm to about 1300 μm, for example, about 400 μm to about 1200 μm, for example, about 500 μm to about 1200 μm.

Referring to FIG. 4, in the plurality of grooves 112, a width w1 of each groove may be about 100 μm to about 1000 μm. For example, the width w1 of each groove may be about 200 μm to about 700 μm, for example, about 300 μm to about 700 μm, for example, about 400 μm to about 600 μm.

Referring to FIG. 4, when the plurality of grooves 112 include the concentric circular groove, a pitch p1 between two adjacent grooves may be about 2 mm to about 70 mm. For example, the pitch p1 of each groove may be about 2 mm to about 60 mm, for example, about 2 mm to about 50 mm, for example, about 2 mm to about 10 mm.

When the structures of the plurality of grooves 112 on the polishing surface 11 satisfy the depth d1, width w1, and pitch p1 in the above-described ranges, it may be more advantageous in excellently implementing the chemical polishing operation by securing the fluidity of the polishing slurry or the polishing liquid, and at the same time, prevent the negative influence on the polishing performance by the mechanical physical properties transmitted through the polishing surface 11 by the engraved portion 111 that is the structural nonuniform element on the surface plate attachment surface 12.

The polishing layer 10 may have a porous structure including a plurality of pores. The average size of the plurality of pores may be about 5 μm to about 50 μm, for example, about 5 μm to about 40 μm, for example, about 10 μm to about 40 μm, for example, about 10 μm to about 35 μm, but is not limited thereto. The plurality of pores may appear as a fine concave portion (not shown) having a part exposed to the outside from the polishing surface of the polishing layer and distinguished from the groove 112, and may serve as the adjustment element of the polishing property by determining the fluidity and mooring space of the polishing liquid or the polishing slurry along with the groove 112 during the use of the polishing pad.

The polishing surface 11 may have a predetermined surface roughness due to the fine concave portion that is distinguished from the groove 112. In one embodiment, the surface roughness Ra of the polishing surface 11 may be about 1/M to about 20 μm. For example, the surface roughness Ra of the polishing surface 11 may be about 2 μm to about 18 μm, for example, about 3 μm to about 16 μm, for example, about 4 μm to about 14 μm.

Referring to FIG. 4, the polishing pad 110 according to one embodiment may include the cushion layer 20 on one surface of the polishing layer 10. The cushion layer 20 may serve as a buffer for alleviating external pressure or external impact transmitted to the surface to be polished in the polishing process while supporting the polishing layer 10. Accordingly, the cushion layer 20 may contribute to preventing the occurrence of damage and defect to the object to be polished in the polishing process to which the polishing pad 110 is applied.

The cushion layer 20 may include a nonwoven fabric or a suede, but is not limited thereto.

In one embodiment, the cushion layer 20 may include a nonwoven fabric. The 'nonwoven fabric' refers to a three-dimensional network structure of nonwoven fiber. Specifically, the cushion layer 20 may include the nonwoven fabric and a resin impregnated into the nonwoven fabric.

The nonwoven fabric may be, for example, a nonwoven fabric of fiber including one selected from the group consisting of polyester fibers, polyamide fibers, polypropylene fibers, polyethylene fibers, and combinations thereof.

The resin impregnated into the nonwoven fabric may include one selected from the group consisting of, for example, a polyurethane resin, a polybutadiene resin, a styrene-butadiene copolymer resin, a styrene-butadiene-styrene copolymer resin, an acrylonitrile-butadiene copolymer resin, a styrene-ethylene-butadiene-styrene copolymer resin, a silicone rubber resin, a polyester-based elastomer resin, a polyamide-based elastomer resin, and combinations thereof.

In one embodiment, the cushion layer 20 may include the non-woven fabric of fiber including polyester fibers with a resin including a polyurethane resin impregnated. In this case, it may be advantageous in smoothly forming the inner surface of the engraved portion 111 in the process of manufacturing the engraved portion 111 to a predetermined depth from the surface plate attachment surface 12.

In one embodiment, the thickness of the cushion layer 20 may be about 0.5 mm to about 2.5 mm, for example, about 0.8 mm to about 2.5 mm, for example, about 1.0 mm to about 2.5 mm, for example, about 1.0 mm to about 2.0 mm, for example, about 1.2 mm to about 1.8 mm.

Referring to FIG. 4, the polishing pad 110 according to one embodiment may include a first adhesive layer 30 for attaching the polishing layer 10 and the cushion layer 20. The first adhesive layer 30 may include, for example, a heat sealing adhesive. Specifically, the first adhesive layer 30 may include one selected from the group consisting of a urethane-based adhesive, an acrylic-based adhesive, a silicone-based adhesive, and a combination thereof, but is not limited thereto.

The polishing pad 110 according to one embodiment may further include a second adhesive layer 40 on the surface plate attachment surface 12. The second adhesive layer 40 is a medium for attaching the polishing pad 110 and the surface plate 120, and may be derived from, for example, a pressure sensitive adhesive (PSA), but is not limited thereto.

In one embodiment, as shown in (a) of FIG. 5, the second adhesive layer 40 may also be present only on the surface plate attachment surface 12 other than the inner surface of the engraved portion 111, and as shown in (b) of FIG. 5, may also be present on the surface plate attachment surface 12 including the inner surface of the engraved portion 111. When the second adhesive layer 40 is present on the surface plate attachment surface 12 other than the inner surface of the engraved portion 111 as shown in (a) of FIG. 5, as shown in (b) of FIG. 5, it may be more advantageous in terms of considering the efficiency of the process of forming the second adhesive layer 4 than a case of being present on the surface plate attachment surface 12 including the inner surface of the engraved portion 111.

The polishing pad 110 according to one embodiment may include a through area (not shown) passing through the uppermost surface and the lowermost surface thereof. The through area is a configuration for detecting a polishing end point during the use of the polishing pad, and may exhibit transmittance of a certain level or more with respect to light having a predetermined wavelength condition. In one embodiment, a light transmission window may be disposed in the through area through at least a part of the entire thickness. For example, in the light transmission window, a transmittance for light of any one of about 500 nm to about 700 nm may be more than about 30%, for example, about 40% to about 80%.

Hereinafter, a method of manufacturing the polishing pad 110 will be described.

The polishing pad 110 may be manufactured by a method including manufacturing the pad including the polishing surface 11 and the surface plate attachment surface 12; and forming at least one engraved portion 111 on the surface plate attachment surface 12 of the pad, in which in the forming of the engraved portion 111, the engraved portion 111 is formed to have the complementary coupling structure with at least one embossed portion 121 on the surface plate to which the polishing pad 110 is attached.

The manufacturing of the pad may include manufacturing the polishing layer 10.

The manufacturing of the polishing layer 10 may include manufacturing the preliminary composition containing prepolymer; manufacturing a composition for manufacturing the polishing layer containing the preliminary composition, a foaming agent and a curing agent; and manufacturing the polishing layer by curing the composition for manufacturing the polishing layer.

The manufacturing of the preliminary composition may be a process of manufacturing the urethane-based prepolymer by reacting the diisocyanate compound and the polyol compound. Matters regarding the diisocyanate compound and the polyol compound are the same as described above with respect to the polishing pad.

The isocyanate group content (NCO %) of the preliminary composition may be about 5 wt % to about 11 wt %, for example, about 5 wt % to about 10 wt %, for example, about 5 wt % to about 8 wt %, for example, about 8 wt % to about 10 wt %, for example, about 8.5 wt % to about 10 wt %. In this case, it may be more advantageous in obtaining the polishing layer having the above-described chemical bonding structure. The content of the isocyanate group in the preliminary composition may be derived from a terminal isocyanate group of the urethane-based prepolymer, the unreacted non-reaction isocyanate group in the diisocyanate compound, etc.

The viscosity of the preliminary composition may be about 100 cps to about 1,000 cps, for example, about 200 cps to about 800 cps, for example, about 200 cps to about 600 cps, for example, about 200 cps to about 550 cps, for example, about 300 cps to about 500 cps at about 80° C.

The foaming agent may include a solid state foaming agent or a gas state foaming agent. Matters regarding the types of the foaming agent, etc. are the same as those described above with respect to the polishing pad.

When the foaming agent includes the solid state foaming agent, the manufacturing of the composition for manufacturing the polishing layer may include manufacturing a first preliminary composition by mixing the preliminary composition and the solid state foaming agent; and manufacturing a second preliminary composition by mixing the first preliminary composition and the curing agent.

The viscosity of the first preliminary composition may be about 1,000 cps to about 2,000 cps, for example, about 1,000 cps to about 1,800 cps, for example, about 1,000 cps to about 1,600 cps, for example, about 1,000 cps to about 1,500 cps at about 80° C.

When the foaming agent includes the gas state foaming agent, the manufacturing of the composition for manufacturing the polishing layer may include manufacturing a third preliminary composition including the preliminary composition and the curing agent; and manufacturing a fourth preliminary composition by injecting the gas state foaming agent into the third preliminary composition.

In one embodiment, the third preliminary composition may further include the solid state foaming agent.

In one embodiment, the process of manufacturing the polishing layer may include preparing a mold preheated at a first temperature; injecting and curing the composition for manufacturing the polishing layer into the preheated mold; and post-curing the cured composition for manufacturing the polishing layer under a second temperature condition higher than the preheating temperature.

In one embodiment, a temperature difference between the first temperature and the second temperature may be about 10° C. to about 40° C., for example, about 10° C. to about 35° C., for example, about 15° C. to about 35° C.

In one embodiment, the first temperature may be about 60° C. to about 100° C., for example, about 65° C. to about 95° C., for example, about 70° C. to about 90° C.

In one embodiment, the second temperature may be about 100° to about 130° C., for example, about 100° C. to 125° C., for example, about 100° C. to about 120° C.

The curing of the composition for manufacturing the polishing layer under the first temperature may be performed for about 5 minutes to about 60 minutes, for example, about 5 minutes to about 40 minutes, for example, about 5 minutes to about 30 minutes, for example, about 5 minutes to about 25 minutes.

The post-curing of the composition for manufacturing the polishing layer cured under the first temperature under the second temperature may be performed for about 5 hours to about 30 hours, for example, about 5 hours to about 25 hours, for example, about 10 hours to about 30 hours, for example, about 10 hours to about 25 hours, for example, about 12 hours to about 24 hours, for example, about 15 hours to about 24 hours.

The manufacturing of the pad may include processing at least one surface of the polishing layer 10.

The machining of at least one surface of the polishing layer may include at least one operation among forming a groove on at least one surface of the polishing layer (1); line turning at least one surface of the polishing layer (2); and roughening at least one surface of the polishing layer (3).

The surface to be processed of the polishing layer 10 may be the polishing surface 11.

In the operation (1), the groove may include at least one of a concentric circular groove formed to be spaced apart from the center of the polishing layer by a predetermined interval; and a radial groove continuously connected from the center of the polishing layer to the edge of the polishing layer.

In the operation (2), the line turning may be performed by a method of cutting the polishing layer by a predetermined thickness using a cutting tool.

In the operation (3), the roughening may be performed by a method of processing the surface of the polishing layer with a sanding roller.

The manufacturing of the pad may further include stacking the cushion layer on the rear surface of the polishing surface of the polishing layer. Matters regarding the cushion layer are the same as those described above with respect to the polishing pad.

The polishing layer and the cushion layer may be stacked via a heat sealing adhesive.

The heat sealing adhesive may be applied to the rear surface of the polishing surface of the polishing layer, the heat sealing adhesive may be applied to the surface coming into contact with the polishing layer of the cushion layer, and the polishing layer and the cushion layer are stacked to come into contact with the surface to which each heat sealing adhesive is applied, and then the two layers may be fused by using a pressurization roller.

The manufacturing of the pad may further include forming an adhesive layer on the rear surface of the polishing layer attachment surface of the cushion layer. At this time, the adhesive layer may be derived from a pressure-sensitive adhesive.

The method of manufacturing the polishing pad includes forming at least one engraved portion 111 on the surface plate attachment surface 12 of the pad.

The engraved portion 111 may be formed by a method of cutting the pad by a predetermined depth from the surface plate attachment surface 12 using a cutting tool having a shape corresponding to the desired shape.

As described above with respect to the polishing system 200 and the polishing pad 110, the engraved portion 111 may be formed in an edge area of the surface plate attachment surface 12.

In one embodiment, at least two engraved portions 111 may be formed, and the relative location structure between any one engraved portion 101 and the other engraved portion 102 is as described above with respect to the polishing system 200 and the polishing pad 110.

In another embodiment, there is provided a method of manufacturing a semiconductor device including: coupling a polishing pad including a polishing surface and a surface plate attachment surface on a rear surface of the polishing surface to a surface plate; and polishing an object to be polished by relatively rotating the polishing pad and the object to be polished under a pressurization condition after disposing the polishing surface to come into contact with a surface to be polished of the object to be polished, in which the object to be polished includes a semiconductor substrate, the surface plate attachment surface includes at least one engraved portion, the surface plate includes at least one embossed portion, and in the coupling of the polishing pad to the surface plate, the embossed portion and the engraved portion are coupled to be engaged with each other.

FIG. 6 is a view schematically showing the method of manufacturing the semiconductor device according to one embodiment. Referring to FIG. 6, the polishing pad 110 includes the polishing surface 11 and the surface plate attachment surface 12, and the surface plate attachment surface 12 includes at least one engraved portion 101, 102, 111. In addition, the surface plate 120 includes at least one embossed part 121 having the complementary coupling structure with the engraved portions 101, 102, 111.

All matters described above with respect to the polishing pad with reference to FIGS. 1 to 5 are interpreted by being integrally applied to the features of the polishing pad in the method of manufacturing the semiconductor device.

In the coupling of the polishing pad 110 to the surface plate 120, the engraved portion 111 and the embossed portion 112 may be disposed by being coupled to each other to be engaged with each other. Accordingly, it is possible to accurately attach and detach the polishing pad 110 to and from the surface plate 120, and as a result, greatly improve the process efficiency of the method of manufacturing the semiconductor device.

Referring to FIG. 6, the surface plate attachment surface 12 of the polishing pad 110 includes at least two engraved portions 111, and when the straight lines from each center of arbitrary first engraved portion 101 and second engraved portion 102 among the at least two engraved portions 111 to the center X of the polishing pad 110 on the surface plate attachment surface 12 are the first straight line L1 and the second straight line L2, respectively, the inner angle θ between the first straight line L1 and the second straight line L2 may satisfy Equation 1 below.

$$-1<\cos\theta<1 \qquad \text{Equation 1}$$

The 'center' of the engraved portion 111 means a midpoint on the center line that bisects the planar shape of the engraved portion 111. For example, as shown in FIGS. 1 and 3, when the planar shape of the engraved portion 111 is a symmetric fan shape, a vertex of the fan shape may be the center of the engraved portion 111.

The 'center' of the polishing pad 110 on the surface plate attachment surface 12 means that point on the surface plate attachment surface 12 when a vertical straight line is drawn from the center of gravity of the polishing pad 110 to the surface plate attachment surface 12.

The 'inner angle' between the first straight line L1 and the second straight line L2 means a relatively small angle of two angles formed by two straight lines with respect to the center of the polishing pad 111 on the surface plate attachment surface 12.

For example, as shown in FIG. 6, when the polishing pad 110 includes three engraved portions 111 on the surface plate attachment surface 12, the straight lines L1, L2 reaching the center of the polishing pad 110 on the surface plate attachment surface 12 are drawn with respect to the arbitrary two engraved portions 101, 102 among the three engraved portions 111, the inner angle θ between the two straight lines may satisfy the value of Equation 1. In other words, even in the case of arbitrary two engraved portions 101, 102 among the three engraved portions 111, the inner angle θ between the two straight lines L1, L2 with respect to the arbitrary two engraved portions 101, 102 may not be 180°. In general, when the polishing pad is attached to the surface plate, a part of a release film previously disposed on the surface plate attachment surface of the polishing pad is released and attached to a correct location of the surface plate, and then the rest of the release film is released and attached in such a way that the surface plate attachment surface of the released portion is attached to the surface plate, and at this time, when arbitrary two engraved portions among the at least two engraved portions 111 exist at location symmetrical to each other, that is, at a location where the inner angle between the two straight lines L1, L2 satisfies 180°, a problem of having difficulty in attaching a second engraved portion to the correct location after first attaching a first engraved portion to the surface plate may occur. In other words, a plurality of engraved portions are disposed so that the inner angle between the first straight line L1 and the second straight line L2 satisfies the condition of Equation 1, so that it is possible to improve accuracy in correspondingly attaching the engraved portions to a plurality of embossed portions on the surface plate, respectively.

Referring to FIG. 2, the polishing pad 110 according to one embodiment includes the polishing layer 10 including the polishing surface 11, and the cushion layer 20 including the surface plate attachment surface 12, and the depth D2 of the engraved portion may satisfy the correlation of Equation 2 below with the thickness D3 of the cushion layer and the thickness D1 of the polishing pad.

$$D3<D2<D1 \qquad \text{Equation 2}$$

When the depth D2 of the engraved portion is too shallow, a structural deformation occurs due to a shear stress generated between the polishing pad 110, the surface plate 120, and the semiconductor substrate, thereby having the negative effect in terms of a change in the location of the polishing pad 110 disposed on the surface plate 120 and a reduction in the polishing degree of uniformity. In the description of another aspect, when the depth D2 of the engraved portion is smaller than or equal to the thickness D3 of the cushion layer, the degree of structural deformation due to the shear stress generated between the polishing pad 110, the surface plate 120, and the semiconductor substrate increases compared to the structural support force of the cushion layer 20, thereby negatively affecting a change in the location of the polishing pad 110 disposed on the surface plate 120 and a reduction in the polishing degree of uniformity thereof. Conversely, when the depth D2 of the engraved portion is too deep and passes through the polishing pad 110 in a thickness direction, the embossed portion 121 of the surface plate is exposed to the outside, resulting in the occurrence of the defect of the surface to be polished of the semiconductor substrate and a reduction in the polishing degree of uniformity. In the description of another aspect, when the depth D2 of the engraved portion is equal to the thickness D1 of the polishing pad, the embossed portion 121 of the surface plate is exposed to the outside, resulting in the occurrence of the defect of the surface to be polished of the semiconductor substrate and a reduction in the polishing degree of uniformity.

As described above with respect to the polishing system 200 and the polishing pad 110, the engraved portion 111 may be formed on the edge area of the surface plate attachment surface 12.

In addition, referring to FIG. 4, as described above with respect to the polishing system 200 and the polishing pad 110, the polishing pad 110 may include the polishing layer 10 including the polishing surface 11 and the cushion layer 20 including the surface plate attachment surface 12, and the polishing surface 11 may include at least one groove 112 having the depth d1 smaller than the thickness D4 of the polishing layer 10. At this time, the depth D2 of the engraved portion may satisfy the correlation of Equation 3 with the thickness D4 of the polishing layer, the depth d1 of the groove, and the thickness D1 of the polishing pad.

$$D1-D4+((D4-d1))/10<D2<D1-D4+((D4-d1))/2 \qquad \text{Equation 3}$$

The groove 112 has a structure for appropriately securing the fluidity of the polishing slurry and the like applied to the polishing surface 11, and is cut to have the depth d1 smaller than the thickness D4 of the polishing layer. Since the polishing surface 11 of the polishing pad is cut and worn as the polishing process continues, the depth d1 of the groove gradually becomes shallower as the polishing process continues. There may occur a problem in that when the depth D2 of the engraved portion is equal to or greater than an upper limit of Equation 3, the nonuniform structure of the engraved portion 111 affects the surface to be polished of the semiconductor substrate through the polishing surface 11 before the polishing surface 11 is cut and worn to reach the maximum life time of the polishing pad 110, thereby reducing the polishing degree of uniformity. In addition, when the depth D2 of the engraved portion is equal to or smaller than a lower limit of Equation 3, it is not possible to secure the structural rigidity according to the complementary coupling structure between the engraved portion 111 of the polishing pad 110 and the embossed portion 121 of the surface plate 120 at a level to resist the shear stress between the polishing pad 110, the surface plate 120, and the semiconductor substrate, and thus there is a concern in that negative results on the change in the location of the polishing pad 110 and the reduction in the polishing degree of uniformity thereof may occur.

The structure sizes of the groove 112 and the engraved portion 11 satisfy the correlation of Equation 3, so that it is possible to obtain the excellent effects in the accuracy of the mechanical coupling according to the complementary coupling structure between the engraved portion 111 and the embossed portion 121 on the surface plate and the polished results of the object to be polished through the polishing surface 11. More specifically, the polishing pad 110 polishes the object to be polished under a pressurized environment of a predetermined pressure during use in the polishing process, and as necessary, a polishing liquid or a polishing slurry is applied to promote a chemical polishing action and the polishing pad 110 is used in wet environments. At this time, the structural sizes of the groove 112 and the engraved portion 111 satisfy the correlation of Equation 3, so that it is possible to satisfy the elastic force and rigidity transmitted to the object to be polished through the polishing surface 11 at a proper level, and at the same time, prevent the permeation of the polishing liquid or the polishing slurry to improve long-term durability.

In the method of manufacturing the semiconductor device, the object to be polished includes a semiconductor substrate. A semiconductor substrate 130 may be disposed so that the surface to be polished thereof comes into contact with the polishing surface 11 of the polishing pad 110. At this time, the surface to be polished of the semiconductor substrate 130 and the polishing surface 11 may also come into direct contact with each other, and also come into indirect contact with each other via a fluidable polishing liquid or a polishing slurry.

In one embodiment, the method of manufacturing the semiconductor device may further include supplying a polishing slurry 150 to the polishing surface 11 of the polishing pad 110. For example, the polishing slurry 150 may be supplied to the polishing surface 11 through a supply nozzle 140.

A flow rate of the polishing slurry 150 injected through the supply nozzle 140 may be about 10 ml/min to about 1,000 ml/min, for example, about 10 ml/min to about 800 ml/min, for example, about 50 $cm^3$/min to about 500 $cm^3$/min, but is not limited thereto. For example, when the flow rate when the polishing slurry 150 is applied to the polishing surface 11 having the groove 112 satisfies the above range, it is possible to secure fluidity of an appropriate level through the groove 112. For example, when the fluidity of the polishing slurry through the groove 112 is too slow, the time the polishing slurry stays in the groove 112 is increased accordingly, thereby negatively affecting the polishing degree of uniformity that needs to be secured at the proper level according to the organic relationship between the depth of the groove 112 and the depth of the engraved portion 111. In other words, as the polishing slurry is injected at the flow rate in the above-described range, it may be more advantageous in securing the technical advantage of the polishing system obtained by the engraved portion 111 and the groove 112 satisfying the above-described correlation of Equation 3.

The polishing slurry 150 may include silica particles or ceria particles, but is not limited thereto.

The semiconductor substrate 130 may be pressurized and polished by a predetermined load on the polishing surface 11 in a state of being mounted on a polishing head 160. The load by which the surface to be polished of the semiconductor substrate 130 is pressurized on the polishing surface 11 by the polishing head 160 may be selected according to the purpose, for example, in the range of about 0.01 psi to about 20 psi, for example, about 0.1 psi to about 15 psi. When the surface to be polished of the semiconductor substrate 130 is pressurized on the polishing surface 11 by the above-described load, the polishing pad 110 may also be pressurized on the surface plate 120 by the corresponding load, and in this case, despite the coupling structure of the engraved portion 111 and the embossed portion 121, the polishing surface 11 may be advantageous in transmitting uniform polishing performance to the surface to be polished of the semiconductor substrate 130 over the entire area.

The semiconductor substrate 130 and the polishing pad 110 may be relatively rotated while the surface to be polished and the polishing surface come into contact with each other. At this time, a rotation direction of the semiconductor substrate 130 and a rotation direction of the polishing pad 110 may also be the same directions or may also be the opposite directions.

Rotation speeds of the semiconductor substrate 130 and the polishing pad 110 may be selected according to the purpose in the range of about 10 rpm to about 500 rpm, respectively, and may be, for example, about 30 rpm to about 200 rpm. When the surface to be polished and the polishing surface are polished in a state of coming into contact with each other while the semiconductor substrate 130 rotates at the rotation speed in the above-described range, and the polishing pad 110 also rotates at the rotation speed in the above-described range, despite the coupling structure of the engraved portion 111 and the embossed portion 121, the polishing surface 11 may be advantageous in transmitting uniform polishing performance to the surface to be polished of the semiconductor substrate 130 over the entire area.

Referring to FIG. 6, the complementary coupling structure of the engraved portion 111 and the embossed portion 121 has a locally non-uniform structure at the interface between the polishing pad 110 and the surface plate 120. Considering a process in which the semiconductor substrate 130 is polished over the entire area of the polishing surface 11 under the pressurization condition, such a non-uniform structure may cause defects in the polished surface of the semiconductor substrate 130 or cause degradation of the resulting polishing flatness. In particular, this is even more so when considering that the thickness of the polishing pad 110 gradually decreases as the polishing process progresses. At this time, the surface to be polished of the semiconductor substrate 130 is polished with respect to the polishing surface 11 under the above-described process conditions, so that it may be more advantageous in minimizing the above-described risk factor due to the complementary coupling structure of the engraved portion 111 and the embossed portion 121.

In one embodiment, the method of manufacturing the semiconductor device may further include processing the polishing surface of the polishing pad 110 through a conditioner 170 while simultaneously polishing the semiconductor substrate 130 so that the polishing surface of the polishing pad 110 continuously maintains a surface roughness suitable for polishing.

Hereinafter, specific examples of the present disclosure are presented. However, examples described below are only for specifically illustrating or describing the present disclosure, and thus the scope of the present disclosure is not limitedly interpreted, and the scope of the present disclosure is determined by the claims.

MANUFACTURING EXAMPLE

Manufacturing Example 1 Manufacturing of Pad

A preliminary composition containing a urethane-based prepolymer was manufactured by mixing a diisocyanate component and a polyol component, putting the mixture into a four-neck flask, and reacting the mixture at 80° C. At this time, the reaction was performed so that the content of an isocyanate group (NCO %) in the preliminary composition was 9 wt %. Aromatic diisocyanate and alicyclic diisocyanate were used as the diisocyanate component, 2,4-TDI and 2,6-TDI were used as the aromatic diisocyanate, and H12MDI was used as the alicyclic diisocyanate. 25 parts by weight of the 2,6-TDI with respect to 100 parts by weight of the 2,4-TDI was used, and 11 parts by weight of the H12MDI with respect to 100 parts by weight of the total aromatic diisocyanate was used. PTMG and DEG were used as the polyol component, and 129 parts by weight of the PTMG and 14 parts by weight of the DEG with respect to 100 parts by weight of the total diisocyanate component were used. 4,4'-methylenebis(2-chloroaniline) (MOCA) was used as a curing agent, and the mixing was performed so that the molar ratio of the amine group ($NH_2$) group in the curing agent to the isocyanate group (NCO group) was 0.96. Then, 1.0 parts by weight of a solid state foaming agent (Akzonobel Co., LTD.) with respect to 100 parts by weight of the preliminary composition was mixed. The preliminary composition was injected into a mold having a width of 1,000 mm, a length of 1,000 mm, and a height of 3 mm, and preheated to 90° C., and injected at a discharge rate of 10 kg/min, and at the same time nitrogen ($N_2$) gas as a gas state foaming agent was injected at an injection speed of 1.0 L/min. Then, a polishing layer with a thickness of a 20 mm was manufactured through the post-curing reaction for the preliminary composition under a temperature condition of 110° C., and groove formation and a line turning.

Then, a plurality of concentric circular grooves were manufactured on one surface of the polishing layer using a multi-biting grooving machine. Each groove has a depth d1 of 850 μm, a width w1 of 480 μm, and a pitch p1 of 3.0 mm.

A cushion layer with the thickness of 10 mm in which a urethane-based resin was impregnated into a polyester resin nonwoven fabric was prepared, a heat sealing adhesive was applied to one surface of the polishing layer, the heat sealing agent was also applied to one surface of the cushion layer, and then the respective adhesive-applied surfaces were bonded by a pressurization roller to come into contact with each other. Then, an adhesive layer for attachment to a surface plate was manufactured by applying and drying a pressure-sensitive adhesive to the other surface of the cushion layer.

Examples and Comparative Example

I. Characteristics According to the Arrangement of the Engraved Portion

With respect to the pad manufactured in Manufacturing Example 1, two or three engraved portions were manufactured on the surface plate attachment surface to which the pressure sensitive adhesive was applied, respectively, but the engraved portions were manufactured to configure the arrangement in which θ1, θ2, and θ3 which are inner angles between the two engraved parts arbitrarily selected as shown in Table 1 below satisfy the following conditions. (a) to (f) of FIG. 7 schematically show the arrangement of the engraved portions of Examples 1-1 to 1-7, respectively. At this time, the depth D2 of the engraved portion was 17.5 mm, the thickness D4 of the polishing layer was 20 mm, the depth d1 of the groove was 0.85 mm, and the total thickness D1 of the polishing pad was 32 mm.

TABLE 1

| | Arrangement of engraved portion | | |
|---|---|---|---|
| | cosθ1 | cosθ2 | cosθ3 |
| Unit | — | — | — |
| Example 1-1 | −0.5 | −0.5 | −0.5 |
| Example 1-2 | 0.71 | −0.5 | −0.97 |
| Example 1-3 | −0.5 | — | — |
| Example 1-4 | −1 | 0 | 0 |
| Example 1-5 | −0.5 | 0.5 | −1 |
| Example 1-6 | −1 | 0.87 | −0.87 |

II. Characteristics According to the Structure of the Engraved Portion

With respect to the pad manufactured in Manufacturing Example 1, three engraved portions were processed on the surface plate attachment surface, but processed so that cos θ1, cos θ2, and cos θ3 of each of θ1, θ2, and θ3, which are inner angles between two engraved portions arbitrarily selected among the three engraved portions satisfy −0.5, respectively. At this time, each engraved portion was processed so that the depth D2 of the engraved portion, the thickness D4 of the polishing layer, the depth d1 of the groove, the thickness D2 of the cushion layer, and the total thickness D1 of the polishing pad satisfied Table 1 below.

TABLE 2

| Unit | D1 mm | D4 mm | d1 mm | D3 mm | D2 mm |
|---|---|---|---|---|---|
| Example 2-1 | 32 | 20 | 0.85 | 12 | 17.5 |
| Example 2-2 | 34 | 20 | 0.84 | 14 | 19.5 |
| Example 2-3 | 36 | 20 | 0.86 | 16 | 21.5 |
| Example 2-4 | 38 | 20 | 0.83 | 18 | 23.5 |
| Example 2-5 | 32 | 20 | 0.85 | 12 | 10 |
| Example 2-6 | 34 | 20 | 0.84 | 14 | 12 |
| Example 2-7 | 36 | 20 | 0.86 | 16 | 14 |

Evaluation

Experimental Example 1: Accuracy Evaluation of Attachment and Detachment of Polishing Pad For each polishing pad of each of the above examples, the polishing pad was attached to and detached from a surface plate provided with an embossed portion having a complementary coupling structure corresponding to each engraved portion, and based on the time taken for attachment and detachment, whether a tool therefor was used, the following criteria were graded depending on the degree of ease and accuracy of attachment and detachment.

(1) Class 1: Time 10 seconds or less, ease of operation High (2) Class 2: Time 10 to 20 seconds, ease of operation Medium (3) Class 3: Time more than 20 seconds, ease of operation Low

Experimental Example 2: Evaluation of Polishing Rate and Polishing Flatness

With respect to the polishing pad of each of the above examples, silicon oxide ($SiO_2$) was deposited on a silicon wafer having a diameter of 300 mm by a chemical vapor deposition (CVD) process. The polishing pad was attached to the CMP equipment, and the surface of the silicon oxide layer of the silicon wafer was installed to face the polishing surface of the polishing pad. While supplying the calcined ceria slurry to the polishing pad at a rate of 250 mL/min, the silicon wafer was pressurized on the polishing surface with a load of 4.0 psi, the rotation speeds of the polishing pad and the silicon wafer was set to 150 rpm, respectively, and the silicon oxide film was polished for 60 seconds. After polishing, the silicon wafer was removed from a carrier, mounted on a spin dryer, washed with distilled water, and dried with nitrogen for 15 seconds.

With respect to the dried silicon wafer, a change in the film thickness before and after polishing was measured by using an optical interference thickness measuring device (SI-F80R, Kyence Co., LTD.). Then, the polishing rate was calculated by using Equation 1 below, and the polishing flatness (within wafer non uniformity: WIWNU) was derived through Equation 2 below using the polishing result for 1 minute. At this time, the measurement was taken 5 times in total and the measured result was expressed as a number average value.

polishing rate (Å/min)=polishing thickness (Å) of silicon wafer/polishing time (min) Equation 1:

polishing flatness (%)=standard deviation of polished thickness (Å)/average polishing thickness (Å)×100 Equation 2:

Experimental Example 3: Defect Prevention Performance Evaluation

The polishing was performed in the same manner as in the polishing process for evaluation of the polishing rate and the polishing flatness, and the number of defects such as scratches was derived by visually observing the polished surface of the object to be polished. Specifically, after polishing, the silicon wafer was moved to a cleaner, and cleaned for 10 seconds using 11 hydrogen fluoride (HF) and purified water (DIW); 1% nitric acid ($H_2NO_3$) and purified water (DIW), respectively. Thereafter, the silicon wafer was moved to a spin dryer, washed with purified water (DIW), and dried with nitrogen ($N_2$) for 15 seconds. A change in defects before and after polishing of the dried silicon wafer was visually observed by using a defect measuring device (XP+, Tenkor Co., LTD.).

The results of Experimental Examples 1 to 3 are as shown in Table 3 below.

TABLE 3

| | | Experimental Examples 2 and 3 | | |
|---|---|---|---|---|
| Unit | Experimental Example 1 Rating | Polishing rate Å/min | Polishing flatness % | Fault Number |
| Example 1-1 | 1 | 3014 | 1.8 | 3 |
| Example 1-2 | 1 | 3022 | 2.1 | 4 |
| Example 1-3 | 1 | 3019 | 2.9 | 6 |
| Example 1-4 | 3 | 3017 | 6.4 | 16 |
| Example 1-5 | 2 | 3030 | 7.2 | 14 |
| Example 1-6 | 2 | 3025 | 6.9 | 17 |
| Example 2-1 | 1 | 3053 | 3.1 | 4 |
| Example 2-2 | 1 | 3034 | 3.4 | 5 |
| Example 2-3 | 1 | 3041 | 3.3 | 4 |
| Example 2-4 | 1 | 3039 | 2.9 | 4 |
| Example 2-5 | 1 | 2987 | 8.1 | 23 |
| Ezample 2-6 | 1 | 3014 | 9.3 | 20 |
| Example 2-7 | 1 | 2999 | 8.7 | 25 |

Referring to Tables 1 to 3, it may be confirmed that all of the polishing pads of Examples 1-1 to 1-6 and the polishing pads of Examples 2-1 to 2-7 are applied to the polishing system in which the surface plate attachment surface includes at least one engraved portion, the surface plate includes at least one embossed portion, and the embossed portion and the engraved portion have the complementary coupling structure, and implement predetermined polishing rate and polishing flatness.

More specifically, it may be confirmed that when the polishing pad of Examples 1-1 to 1-3 are compared with the polishing pads of Examples 1-4 to 1-6, the polishing pad of Examples 1-1 to 1-3 have the inner angle θ between the first straight line and the second straight line satisfying a range of $-1<\cos\theta<1$ when the straight lines from the center of each engraved portion to the center of the polishing pad on the surface plate attachment surface with respect to arbitrary two engraved portions among three engraved portions are the first straight line and the second straight line, thereby improving accuracy of the attachment and detachment of the polishing pad compared to the polishing pads of Examples 1-4 to 1-6 in which the case of $\cos\theta=-1$ is at least included. Furthermore, it may be seen that the polishing pads of Examples 1-1 to 1-3 have the polishing flatness of less than 5%, whereas the polishing pads of Examples 1-4 to 1-6 have the polishing flatness of more than 5%, and it may be confirmed that the polishing pads of Examples 1-1 to 1-3 have the number of defects of less than 10, more specifically, 6 or less, whereas the polishing pads of Examples 1-4 to 1-6 have the number of defects of more than 10, and the polishing pads of Examples 1-1 to 1-3 have better performance in terms of polishing flatness and defects.

Meanwhile, it may be confirmed that when the polishing pads of Examples 2-1 to 2-4 are compared with the polishing pads of Examples 2-5 to 2-7, the depth D2 of the engraved portion satisfies the relationship of D3<D2<D1 in the thickness D3 of the cushion layer and the thickness D1 of the polishing pad, and furthermore, the polishing pads of Examples 2-1 to 2-4 are polishing pads that also satisfy the correlation of Equation 3, and have the polishing flatness of less than 4% and defects of 5 or less, thereby implementing very excellent polishing performance, whereas the Examples 2-5 to 2-7 are polishing pads that do not satisfy the correlation of Equation 2 and/or Equation 3, and have the polishing flatness of more than 55 and defects of or more, thereby implementing inferior polishing performance.

The polishing pad according to one embodiment has the advantage of enabling the accurate attachment and easy detachment between the polishing pad and the surface plate through the complementary coupling structure between the engraved portion and the embossed portion, thereby preventing damage to and deformation of the surface plate to prolong the life time of the system, and greatly improving the polishing efficiency by shortening the process time to eventually implement the excellent polishing performance in terms of the polishing rate, the polishing flatness, and the defect prevention. Furthermore, when Equation 1 related to the relative location between the plurality of engraved portions and Equation 2 and Equation 3 related to the depth of the engraved portion are satisfied, these technical advantages are further maximized, thereby implementing excellent polishing performance.

What is claimed is:

1. A polishing system comprising:

a surface plate having a polishing pad mounted on an upper portion of the surface plate;

wherein the polishing pad includes:

a polishing layer including the polishing surface; and a cushion layer including a surface plate attachment surface, the surface plate attachment surface includes: at least one engraved portion, the surface plate includes at least one embossed portion, and the embossed portion and the engraved portion have a complementary coupling structure, and a depth D2 of the engraved portion satisfies the correlation of Equation 2 below with a thickness D3 of the cushion layer and a thickness D1 of the polishing pad:

$$D3<D2<D1. \quad \text{Equation 2}$$

2. The polishing system of claim 1, wherein the surface plate attachment surface includes: at least two engraved portions, and when straight lines from a center of each of an arbitrary first engraved portion and second engraved portion among the at least two engraved portions to a center of the polishing pad on the surface plate attachment surface are a first straight line and a second straight line, an inner angle θ between the first straight line and the second straight line satisfies Equation 1 below:

$$-1<\cos\theta<1. \quad \text{Equation 1}$$

3. The polishing system of claim 2, wherein a center of the first engraved portion is a midpoint on a center line that bisects a planar shape of the first engraved portion.

4. The polishing system of claim 1, wherein the polishing surface includes at least one groove having a depth smaller than the thickness of the polishing layer, and the depth D2 of the engraved portion satisfies the correlation of Equation 3 below with a thickness D4 of the polishing layer, a depth d1 of the groove, and a thickness D1 of the polishing pad:

$$D1-D4+((D4-d1))/10<D2<D1-D4+((D4-d1))/2. \quad \text{Equation 3}$$

5. The polishing system of claim 1, wherein the surface plate attachment surface includes: a center area and an edge area, the edge area is an area directly adjacent to a rim of the surface plate attachment surface and has a thickness R1 along a straight line from the rim toward the center of the polishing pad, and a straight distance from the rim of the surface plate attachment surface toward the center of the polishing pad corresponds to R2, a ratio of R1 to R2 is 0.2:1 to 0.5:1, and the engraved portion is located in the edge area.

6. The polishing system of claim 5, wherein the polishing surface includes: two or more grooves, and the groove has a depth of 100 μm to 1500 μm, and a width of 100 μm to 1000 μm, and a pitch between adjacent two grooves is 2 mm to 70 mm.

7. The polishing system of claim 1, further comprising a supply nozzle for applying a fluid to the polishing surface, as necessary.

8. The polishing system of claim 1, further comprising a polishing head in which a pressurization load of the polishing pad to the surface plate is adjusted within a range of 2 psi to 7 psi.

9. A polishing pad comprising:

a polishing layer including the polishing surface; and a cushion layer including the surface plate attachment surface, wherein the surface plate attachment surface includes: at least one engraved portion, the engraved portion has a complementary coupling structure with an embossed portion on a surface plate to be mounted through the surface plate attachment surface, and a depth D2 of the engraved portion satisfies the correlation of Equation 2 below with a thickness D3 of the cushion layer and a thickness D1 of the polishing pad:

$$D3<D2<D1. \quad \text{Equation 2}$$

10. The polishing pad of claim 9, wherein the polishing surface includes at least one groove having a depth smaller than the thickness of the polishing layer, and the depth D2 of the engraved portion satisfies the correlation of Equation 3 below with a thickness D4 of the polishing layer, a depth d1 of the groove, and a thickness D1 of the polishing pad:

$$D1-D4+((D4-d1))/10<D2<D1-D4+((D4-d1))/2. \quad \text{Equation 3}$$

11. The polishing pad of claim 10, wherein the polishing surface includes: two or more grooves, the groove has a depth of 100 μm to 1500 μm, and a width of 100 μm to 1000 μm, and a pitch between adjacent two grooves is 2 mm to 70 mm.

12. The polishing pad of claim 9, wherein the polishing layer includes: a cured product of a preliminary composition including a urethane-based prepolymer, and the content of an isocyanate group (NCO %) in the preliminary composition is 5 wt % to 11 wt %.

13. A method of manufacturing a semiconductor device, the method comprising:

coupling a polishing pad including a polishing surface and a surface plate attachment surface on a rear surface of the polishing surface to a surface plate; and polishing an object to be polished while relatively rotating the polishing pad and the object to be polished under a pressurization condition after a surface to be polished of the object to be polished is disposed to come into contact with the polishing surface, wherein the object to be polished includes: a semiconductor substrate, the polishing pad includes:

a polishing layer including the polishing surface; and a cushion layer including the surface plate attachment surface, the surface plate attachment surface includes: at least one engraved portion, the surface plate includes: at least one embossed portion, and in the coupling of the polishing pad to the surface plate, the embossed portion and the engraved portion are coupled to be engaged with each other, and a depth D2 of the engraved portion satisfies the correlation of Equation 2 below with a thickness D3 of the cushion layer and a thickness D1 of the polishing pad:

$$D3<D2<D1. \quad \text{Equation 2}$$

14. The method of claim 13, wherein a load by which the surface to be polished of the object to be polished is pressurized on the polishing surface of the polishing layer is 0.01 psi to 20 psi.

15. The method of claim 13, wherein rotation speeds of the polishing pad and the object to be polished are 10 rpm to 500 rpm, respectively.

16. The method of claim 13, further comprising: a supply nozzle for applying a fluid to the polishing surface, as necessary.

17. The method of claim 13, wherein the surface plate attachment surface includes: at least two engraved portions, and when straight lines from a center of each of an arbitrary first engraved portion and second engraved portion among the at least two engraved portions to a center of the polishing pad on the surface plate attachment surface are a first straight line and a second straight line, an inner angle θ between the first straight line and the second straight line satisfies Equation 1 below:

$$-1<\cos\theta<1. \quad \text{Equation 1}$$

* * * * *